US008105744B2

(12) United States Patent
Matsumura

(10) Patent No.: US 8,105,744 B2
(45) Date of Patent: Jan. 31, 2012

(54) IMAGE FORMING METHOD AND IMAGE FORMING APPARATUS

(75) Inventor: Yasuo Matsumura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 675 days.

(21) Appl. No.: 12/073,952

(22) Filed: Mar. 12, 2008

(65) Prior Publication Data

US 2009/0053631 A1 Feb. 26, 2009

(30) Foreign Application Priority Data

Aug. 24, 2007 (JP) ..... 2007-218206

(51) Int. Cl.
*G03G 13/00* (2006.01)

(52) U.S. Cl. ..... 430/124.23; 430/110.2; 430/124.1

(58) Field of Classification Search ..... 430/110.1, 430/110.2, 123.5, 124.1, 124.23
See application file for complete search history.

(56) References Cited

U.S. PATENT DOCUMENTS

| | | | | |
|---|---|---|---|---|
| 4,543,311 | A * | 9/1985 | Takagiwa et al. | 430/123.55 |
| 4,612,273 | A | 9/1986 | Westdale et al. | |
| 5,428,435 | A * | 6/1995 | Yasuda et al. | 430/123.55 |
| 5,443,936 | A * | 8/1995 | Yasuda et al. | 430/124.31 |
| 5,802,440 | A * | 9/1998 | Maeyama | 430/45.5 |
| 6,033,822 | A | 3/2000 | Hasegawa et al. | |
| 2004/0175208 | A1 * | 9/2004 | Ichida et al. | 399/302 |
| 2005/0277043 | A1 | 12/2005 | Tanma et al. | |
| 2007/0048647 | A1 * | 3/2007 | Daimon et al. | 430/110.2 |
| 2007/0073000 | A1 | 3/2007 | Mayes et al. | |

FOREIGN PATENT DOCUMENTS

| | | |
|---|---|---|
| AU | 2006235981 A1 | 12/2007 |
| JP | A-49-17739 | 2/1974 |
| JP | A-57-201246 | 12/1982 |
| JP | A-58-86557 | 5/1983 |
| JP | A-61-56355 | 3/1986 |
| JP | A-2-61646 | 3/1990 |
| JP | A-6-167830 | 6/1994 |
| JP | A-2000-122346 | 4/2000 |
| JP | A-2000-147829 | 5/2000 |
| JP | A-2005-091436 | 4/2005 |

(Continued)

OTHER PUBLICATIONS

Gonzalez-Leon et al; "Core-Shell Polymer Nanoparticles for Baroplastic Processing;" *Macromolecules*; vol. 38; pp. 8036-8044; 2005.

(Continued)

*Primary Examiner* — Mark F Huff
*Assistant Examiner* — Stewart Fraser
(74) *Attorney, Agent, or Firm* — Oliff & Berridge, PLC

(57) ABSTRACT

An image forming method includes forming an electrostatic latent image on a surface of a latent image carrier; developing the electrostatic latent image with a developing agent including a toner to form a toner image; transferring the toner image onto a surface of a target to obtain a transferred toner image; and fixing the transferred toner image; wherein the toner includes a resin particle having a core-shell structure, both of a resin constituting the core and a resin constituting the shell are a non-crystalline resin, glass transition temperatures of the resin constituting the core and the resin constituting the shell are different by about 20° C. or greater, the resin constituting the shell includes an acidic polar group, a basic polar group, or an alcoholic hydroxy group, and the fixing of the transferred toner image is performed by applying a pressure on the transferred toner image without heating.

16 Claims, 1 Drawing Sheet

FOREIGN PATENT DOCUMENTS

| | | |
|---|---|---|
| JP | A-2005-91705 | 4/2005 |
| JP | A-2005-91707 | 4/2005 |
| JP | A-2005-099079 | 4/2005 |
| JP | A-2005-099081 | 4/2005 |
| JP | A-2005-099082 | 4/2005 |
| JP | A-2005-195670 | 7/2005 |
| JP | A-2006-23720 | 1/2006 |
| JP | A-2006-516299 | 6/2006 |
| JP | A-2007-310064 | 11/2007 |
| JP | A-2008-158197 | 7/2008 |

OTHER PUBLICATIONS

Ha et al; "Preparation and Characterization of Core-Shell Particles Containing Perfluoroalkyl Acrylate in the Shell;" *Macromolecules*; vol. 35; pp. 6811-6818; 2002.

Ryu et al; "Complex Phase Behavior of a Weakly Interacting Binary Polymer Blend;" *Macromolecules*; vol. 37; pp. 5851-5855; 2004.

Dec. 17, 2010 Office Action issued in Chinese Patent Application No. 200810085746.1 (with translation).

* cited by examiner

FIGURE
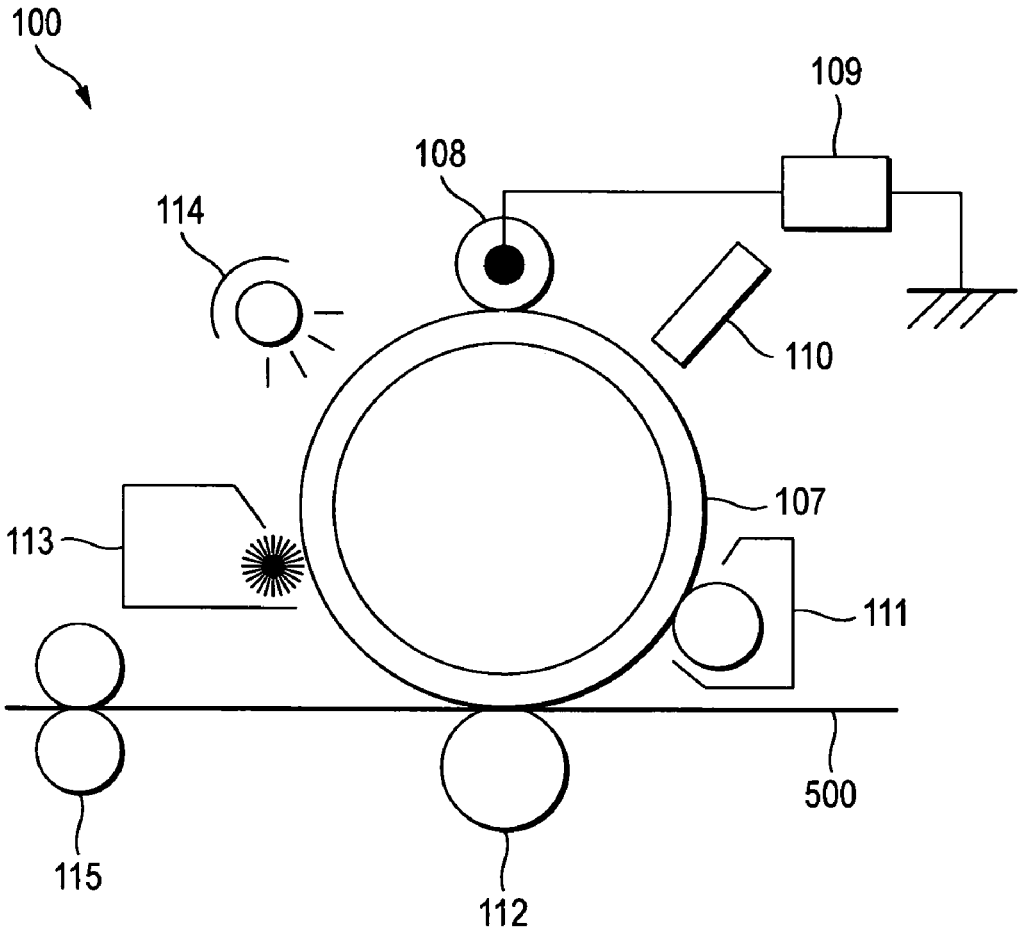

IMAGE FORMING METHOD AND IMAGE FORMING APPARATUS

CROSS-REFERENCE TO RELATED APPLICATIONS

This application is based on and claims priority under 35 USC 119 from Japanese Patent Application No. 2007-218206 filed on Aug. 24, 2007.

BACKGROUND

1. Technical Field

The present invention relates to an image forming method and an image forming apparatus.

2. Related Art

Fixing of electrostatic image developing toners containing an addition polymerization resin or polycondensation resin as a binder resin is mainly accelerated by heating rather than application of pressure because they are based on random chaining of monomers.

SUMMARY

According to an aspect of the invention, there is provided an image forming method including: forming an electrostatic latent image on a surface of a latent image carrier; developing the electrostatic latent image with a developing agent including a toner to form a toner image; transferring the toner image onto a surface of a target to obtain a transferred toner image; and fixing the transferred toner image; wherein the toner includes a resin particle having a core-shell structure, both of a resin constituting a core of the core-shell structure and a resin constituting a shell of the core-shell structure are a non-crystalline resin, a glass transition temperature of the resin constituting the core and a grass transition temperature of the resin constituting the shell are different by about 20° C. or greater, the resin constituting the shell includes an acidic polar group, a basic polar group, or an alcoholic hydroxy group, and the fixing of the transferred toner image is performed by applying a pressure on the transferred toner image without heating.

BRIEF DESCRIPTION OF THE DRAWINGS

Exemplary embodiment(s) of the present invention will be described in detail based on the following FIGURE, wherein:

FIGURE is a cross-sectional view schematically illustrating the basic constitution of one preferred exemplary embodiment of an image forming apparatus of the invention.

DETAILED DESCRIPTION

An image-forming method according to the invention includes: An image forming method, which includes:

(a) a step of forming an electrostatic latent image on the surface of a latent image carrier, (b) a step of developing the electrostatic latent image with a developing agent containing a toner to form a toner image, (c) a step of transferring the toner image onto the surface of a member to be transferred to obtain a transferred toner image; and (d) a step of fixing the transferred toner image onto the surface of the member to be transferred; wherein the toner is an electrostatic image developing toner available by aggregating resin particles having a core-shell structure; resins constituting the core and shell are each a non-crystalline resin; the resin constituting the core and the resin constituting the shell are different in glass transition temperature by 20° C. or greater; the resin constituting the shell contains an acidic or basic polar group, or an alcoholic hydroxy group; and the fixing step is a step of fixing the toner image by applying a pressure without heating.

In the fixing step, the fixing pressure (maximum fixing pressure) is preferably 1.5 MPa or greater but not greater than 10 MPa.

When the toners as described in Japanese Patent Laid-Open Nos. 17739/1974, 86557/1983, 201246/1982, and 56355/1986 are used for an ordinary electrophotographic process, their fixing ability is not sufficient and owing to adhesion (filming) of the toner onto a photoreceptor, they cause image defects. Such drawbacks occur presumably because of an insufficient pressure yield behavior of the toners.

In the invention, by using an electrostatic image developing toner containing a specific resin as a binder resin, a toner image can be transferred only by application of pressure without heating.

First, a toner to be used in the invention and then an image forming method of the invention will next be described.

(Toner)

A toner to be used in the invention is an electrostatic image developing toner available by the aggregation of resin particles having a core-shell structure. The resins constituting the core and shell are each a non-crystalline resin. The core-constituting resin and the shell-constituting resin are different in glass transition temperature (Tg) by 20° C. or greater. The shell-constituting resin contains an acidic or basic polar group, or an alcoholic hydroxy group.

When a high-Tg resin (resin having a higher glass transition temperature) and a low-Tg resin (resin having a lower glass transition temperature) form a micro-phase separated state, these resins are plasticized by application of a pressure thereto and show fluidity even at a normal temperature range under a certain pressure or greater. Such a resin may be called "baroplastic". When the atmospheric temperature is high, such a behavior is accelerated and resin fluidity necessary for fixing can be attained even by the application of a lower pressure.

In an electrophotographic process, during steps other than thermal pressure fixing step such as developing, transferring and cleaning steps, high reliability is ensured by imparting fluidity to the toner at a certain pressure or greater and allowing the toner to behave as if it is a solid at a pressure less than the certain pressure.

The high reliability thus attained enables the use of a toner having a particle size as small as 5 μm which cannot be realized so far. By this, both a reduction in the consumption amount of toners and formation of a high-definition image can be accomplished. As a result, high image quality, high reliability and economy due to a reduction in the consumption amount of toners can be satisfied simultaneously.

The maximum pressure during pressure fixing using a fixing machine in the conventional electrophotographic process is typically 1 MPa or less. It is however often set at from 0.2 MPa or greater but not greater than 0.6 MPa.

The principal effect and advantage of the invention are to satisfy both a low-temperature fixing property and high reliability by positively utilizing a pressure-induced plasticization effect of micro-phase-separated resins different in Tg domain by application of a pressure during fixing.

<Binder Resin>

[Core-Shell Particles]

The toner to be used in the invention is an electrostatic image developing toner available by aggregation of resin particles having a core-shell structure (which may hereinafter be called "core-shell particles" simply). The resins constituting the core and shell are each a non-crystalline resin. The core-constituting resin and the shell constituting resin are different in glass transition temperature (Tg) by 20° C. or greater. The shell-constituting resin contains an acidic or basic polar group, or an alcoholic hydroxy group.

In the core-constituting resin and shell-constituting resin, a core or shell having a higher Tg may be called "high Tg phase", while a core or shell having a lower Tg may be called "low Tg phase".

The high Tg phase has a Tg of preferably about 40° C. or greater but not greater than about 80° C. (which may be described hereinafter as "from about 40 to 80° C." or "from about 40° C. to about 80° C.", which will equally apply hereinafter), more preferably from about 45 to 70° C.

When the high Tg phase has a Tg of 40° C. or greater, the resulting toner has excellent storage stability, does not easily cause caking during transport or in a printer or the like. In addition, it causes neither filming to a photoreceptor nor image defects during continuous printing. When the high Tg phase has a Tg not greater than 80° C., on the other hand, the fixing temperature during fixing is adequate and damages such as curling of a member to be recorded do not occur. In addition the toner can be fixed without heating. The Tg of the high Tg phase within the above-described range is therefore preferred.

The Tg of the low Tg phase must be lower by about 20° C. or greater, preferably about 30° C. or greater than that of the high Tg phase. When a difference between these phases is less than 20° C., the pressure-induced plasticization of the resins is not observed sufficiently and a higher fixing temperature is required. It therefore becomes difficult to fix the toner without heating.

The glass transition temperature of the resin can be measured in a known manner, for example, by a method (DSC method) as specified in ASTM D3418-82.

The term "crystalline" in the crystalline resin means that the resin does not show a stepwise endothermic change but shows an apparent endothermic peak in differential scanning calorimetry (DSC). More specifically, it means that a half width of the endothermic peak as measured at a heating rate of 10° C./min is within 15° C.

A resin having a half width of an endothermic peak exceeding 15° C. or a resin showing no apparent endothermic peak is non-crystalline (amorphous). The glass transition temperature of the non-crystalline resin by DSC is measured in accordance with ASTM D3418 by using a differential scanning calorimeter ("DSC-50", trade name; manufactured by Shimadzu Corporation) equipped with an automatic tangent treatment system. Measurement conditions are shown below.

Sample: from 3 to 15 mg, preferably from 5 to 10 mg

Measuring method: A sample is placed in an aluminum pan and a blank aluminum pan is used as a reference.

Temperature curve: Elevation of temperature I (from 20 to 80° C. at a temperature elevation rate of 10° C./min)

The glass transition temperature is determined from an endothermic curve of the temperature curve as measured at the temperature elevation time. The glass transition temperature means a temperature at which the derivative value of the endothermic curve becomes the maximum.

Core-shell particles having a core and a shell made of resins different in Tg are available, for example, by carrying out stepwise supply of monomers to a polymerization system in emulsion polymerization, which process is called "2 stage field".

Mixing and processing of core-shell particles at a high temperature and high pressure by using a conventional technique for toner formation such as kneading may collapse the precisely formed phase separated structure and prevent the resulting toner from having intended properties. A process of forming toner particles in a water-based medium using water or the like as a medium is therefore suited.

For the formation, in accordance with dissolution suspension or emulsion polymerization aggregation method, of a toner by using the above-described resins as a binder resin, a conventionally known preparation process can be employed.

Examples of a preparation process of core-shell particles composed of a core-constituting resin and a shell-constituting resin different in Tg include "Core-shell Polymer Nanoparticles for Baroplastic Processing", *Macromolecules,* 38, 8036-8044 (2005), "Preparation and Characterization of Core-shell Particles Containing Perfluoroalkyl Acrylate in the Shell", *Macromolecules,* 35, 6811-6818 (2002), "Complex Phase Behavior of a Weakly Interacting Binary Polymer Blend", *Macromolecules,* 37, 5851-5855 (2004).

In the invention, a resin usable for core-shell particles is not particularly limited insofar as it is a non-crystalline resin and the core-constituting resin and the shell-constituting resin are different in Tg by 20° C. or greater. It is preferably a non-crystalline and addition polymerization resin, more preferably a non-crystalline homopolymer or copolymer of an ethylenically-unsaturated monomer.

Preferred examples of the monomer constituting such a homopolymer or copolymer include styrenes such as styrene, parachlorostyrene and α-methylstyrene, (meth)acrylate esters such as methyl acrylate, ethyl acrylate, propyl acrylate, butyl acrylate, lauryl acrylate, 2-ethylhexyl acrylate, methyl methacrylate, ethyl methacrylate, propyl methacrylate, butyl methacrylate, hexyl methacrylate, lauryl methacrylate and 2-ethylhexyl methacrylate, ethylenically unsaturated nitriles such as acrylonitrile and methacrylonitrile, ethylenically unsaturated carboxylic acids such as acrylic acid, methacrylic acid and crotonic acid, vinylethers such as vinyl methyl ether and vinyl isobutyl ether, vinylketones such as vinyl methyl ketone, vinyl ethyl ketone and vinyl isopropenyl ketone, olefins such as isoprene, butene and butadiene, and β-carboxyethyl acrylate. Homopolymers composed of any one of these monomers, copolymers obtained by copolymerizing two or more of these monomers, or mixtures thereof are usable.

Preferred specific examples of the combination of two resins different in Tg by 20° C. or greater and forming a microphase separated structure include a combination of polystyrene and polybutyl acrylate, that of polystyrene and polybutyl methacrylate, that of polystyrene and poly(2-ethylhexyl acrylate), that of polymethyl methacrylate and polybutyl methacrylate, that of polystyrene and polyhexyl methacrylate, that of polyethyl methacrylate and polyethyl acrylate, and that of polyisoprene and polybutylene.

The core-shell particles using the above-described combination of two resins show pressure-induced plasticization whenever either of the two is a core-constituting resin or shell-constituting resin. The shell-constituting resin is preferably a high-Tg phase in order to satisfy durability during transport or storage of the resulting toner.

It is more preferred that 80 wt. % or greater of the shell-constituting resin of the core-shell particles is composed of a styrene, while 80 wt. % or greater of the core-constituting resin is composed of a (meth)acrylate. It is especially preferred that 80 wt. % or greater of the core-constituting resin is composed of an acrylate.

The core-constituting resin has a weight-average molecular weight of preferably from about 3,000 to about 50,000, more preferably from about 5,000 to about 40,000. Weight-average molecular weights within the above-described range are preferred, because a fixing property and image intensity after fixing can be easily satisfied simultaneously.

The shell-constituting resin has a weight average molecular weight of preferably from about 3,000 to about 50,000, more preferably from about 5,000 to about 40,000. Weight-average molecular weights within the above-described range are preferred, because a fixing property and prevention of filming onto a photoreceptor can be easily satisfied simultaneously.

The content of the core-shell particles is preferably about 20% or greater based on the total weight of the toner in order to achieve the object. The content is more preferably from about 30 to 98%, still more preferably from about 50 to 98%. The contents within the above-described range are preferred because the resulting toner can have a good pressure fixing property.

In order to add these particles as a toner composition in an amount of 50 wt. % or greater, the particles must be controllable in a water-based medium at the time of toner formation, that is, particle size and particle size distribution of the particles must be controllable. To facilitate control of them by the addition of an aggregating agent, addition of an acidic or basic polar group or an alcoholic hydroxy group to the resin of the particles is effective. This may be achieved by copolymerization of a monomer having such a polar group mainly with the shell component.

Preferred examples of the acidic polar group include carboxyl group, sulfonic acid group and acid anhydride.

Examples of the monomer for forming the acidic polar group in the resin include α,β-ethylenically unsaturated compounds having a carboxyl group or a sulfone group and preferred specific examples include acrylic acid, methacrylic acid, fumaric acid, maleic acid, itaconic acid, cinnamic acid, sulfonated styrene and allylsulfosuccinic acid.

As the basic polar group, amino, amide, hydrazide and the like groups are preferred.

Examples of the monomer for forming the basic polar group in the resin are the monomer structure units having a nitrogen atom (which may hereinafter be called "nitrogen-containing monomers"). Preferred examples of the compound used as the monomer structure unit include (meth) acrylic amide compounds, (meth)acrylic hydrazide compounds and aminoalkyl (meth)acrylate compounds.

The following are examples of the monomers. The (meth) acrylic amide compounds include acrylic amide, methacrylic amide, acrylic methylamide, methacrylic methylamide, acrylic dimethylamide, acrylic diethylamide, acrylic phenylamide and acrylic benzylamide.

The (meth)acrylic hydrazide compounds include acrylic hydrazide, methacrylic hydrazide, acrylic methylhydrazide, methacrylic methylhydrazide, acrylic diemthylhydrazide and acrylic phenylhydrazide.

The aminoalkyl (meth)acrylate compounds include 2-aminoethyl acrylate and 2-aminoethyl methacrylate. The aminoalkyl (meth)acrylate compounds may be monoalkylaminoalkyl (meth)acrylate compounds or dialylaminoalkyl (meth)acrylate compounds and examples of them include 2-(diethylamino)ethyl (meth)acrylate.

As the monomer for forming an alcoholic hydroxy group, hydroxyacrylates are preferred. Specific examples thereof include 2-hydroxyethyl (meth)acrylate, hydroxypropyl (meth)acrylate and hydroxybutyl (meth)acrylate.

The content of the monomer having a polar group is preferably from 0.01 to 20 wt. %, more preferably from 0.1 to 10 wt. % based on the total weight of the polymerizable monomers used for the shell layer. The contents within the above-described range are preferred because controllability can be imparted to the core-shell particles during toner formation in a water-based medium.

The polymerization reaction may be performed in a water-based medium.

Examples of the water-based medium usable in the invention include water such as distilled water and deionized water and alcohols such as ethanol and methanol. Of these, ethanol and water are preferred, with water such as distilled water and deionized water being especially preferred. They may be used either singly or in combination.

The water-based medium may contain a water-miscible organic solvent. Examples of the water-miscible organic solvent include acetone and acetic acid.

The polymerization reaction may be performed using an organic solvent.

Specific examples of the organic solvent usable in the invention include hydrocarbon solvents such as toluene, xylene and mesitylene; halogen solvents such as chlorobenzene, bromobenzene, iodobenzene, dichlorobenzene, 1,1,2,2-tetrachloroethane and p-chlorotoluene; ketone solvents such as 3-hexanone, acetophenone and benzophenone; ether solvents such as dibutyl ether, anisole, phenetole, o-dimethoxybenzene, p-dimethoxybenzene, 3-methoxytoluene, dibenzyl ether, benzyl phenyl ether, methoxynaphthalene and tetrahydrofuran; thioether solvents such as phenyl sulfide and thioanisole; ester solvents such as ethyl acetate, butyl acetate, pentyl acetate, methyl benzoate, methyl phthalate, ethyl phthalate and cellosolve acetate; and diphenyl ether solvents, for example, diphenyl ether, alkyl-substituted diphenyl ethers such as 4-methyldiphenyl ether, 3-methyldiphenyl ether and 3-phenoxytoluene, halogen-substituted diphenyl ethers such as 4-bromodiphenyl ether, 4-chlorodiphenyl ether, and 4-methyl-4'-bromodiphenyl ether, alkoxy-substituted diphenyl ethers such as 4-methoxydiphenyl ether, 3-methoxydiphenyl ether and 4-methyl-4'-methoxydiphenyl ether, and cyclic diphenyl ethers such as dibenzofuran and xanthene. These solvents may be used as a mixture.

In the core-shell particles, a weight ratio of the core-constituting resin and the shell-constituting resin is preferably from 10:90 to 90:10, more preferably from 15:85 to 85:15 (core:shell). Weight ratios within the above-described range are preferred because a pressure fixing property is good.

The median diameter (middle diameter) of the core-shell particles is preferably from about ½ to about 1/1,000, preferably from about ⅕ to about 1/1,000, more preferably from about 1/10 to about 1/200 relative to the volume-average particle size of the toner. The median diameters within the above-described range are preferred because they facilitate control of the particle size of the toner.

The core-shell particles have a median diameter of preferably from 0.01 to 1.0 μm, more preferably from 0.05 to 0.7 μm, still more preferably from 0.1 to 0.5 μm. The median diameters of the core-shell particles within the above-described range are preferred because they facilitate control of the particle size distribution of the toner.

The median diameter of the core-shell particles can be measured in a known manner, for example, by a laser diffraction particle size distribution analyzer ("LA-920", trade name; product of Horiba, Ltd.).

A method of confirming the presence of a plurality of the core-shell particles in the toner is not particularly limited. Examples of it include observation of the cross-section of the toner with a transmission electron microscopy and observation, with a scanning electron microscope, of the cross-section with an enhanced contrast by staining. The presence of two or more core-shell particles contained in the toner is sometimes apparent from a ratio of the toner particle size to the core-shell particles upon preparation, using amount of the core-shell particles or preparation process.

These core-shell particles subjected to pressure-induced plasticization may be used either singly as a binder resin or as a mixture with conventional resin particles prepared by the emulsion polymerization.

In the latter case, the proportion of the core-shell particles is preferably 30 wt. % or greater in all the binder resins used for toner formation from the viewpoint of achieving the object of the invention. The proportion is more preferably from 40 to 100 wt. %, still more preferably from 50 to 100 wt. %.

In the invention, the binder resin may contain a product obtained by polycondensation or polymerization reaction of the monomer and a prepolymer of the monomer prepared in advance. The prepolymer is not limited insofar as it can be dissolved in or uniformly mixed with the monomer.

The binder resin usable in the invention may contain a homopolymer of the above-described monomer, a copolymer obtained using in combination two or more of monomers including the above-described monomer, or a mixture or graft polymer of them which may partially contain a branched or crosslinked structure.

The binder resin usable in the invention can be converted into a crosslinking resin by adding thereto a crosslinking agent as needed. The crosslinking agent is typically a polyfunctional monomer having, in the molecule thereof, two or more ethylene type polymerizable unsaturated groups.

Specific examples of such a crosslinking agent include aromatic polyvinyl compounds such as divinylbenzene and divinylnaphthalene; polyvinyl esters of an aromatic polycarboxylic acid such as divinyl phthalate, divinyl isophthalate, divinyl terephthalate, divinyl homophthalate, divinyl/trivinyl trimesate, divinyl naphthalenedicarboxylate, and divinyl biphenylcarboxylate; divinyl esters of a nitrogen-containing aromatic compound such as divinyl pyridinedicarboxylate; vinyl esters of an unsaturated heterocyclic compound carboxylic acid such as vinyl pyromucate, vinyl furancarboxylate, vinyl pyrrole-2-carboxylate, and vinyl thiophenecarboxylic acid; polyfunctiona (meth)acrylates of a linear polyhydric alcohol such as butanediol dimethacrylate, hexanediol diacrylate, octanediol dimethacrylate, decanediol diacrylate, and dodecanediol dimethacrylate; (meth)acrylates of a branched, substituted polyhydric alcohol such as neopentylglycol dimethacrylate and 2-hydroxy-1,3-diacryloxypropane; polyethylene glycol di(meth)acrylate; polypropylene polyethylene glycol di(meth)acrylates; and polyfunctional vinyl esters of a polycarboxylic acid such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedicarboxylate, and divinyl brassylate.

In the invention, these crosslinking agents may be used either singly or in combination. Of the above crosslinking agents, preferred are polyfunctional (meth)acrylates of a linear polyhydric alcohol such as butanediol dimethacrylate, hexanediol diacrylate, octanediol dimethacrylate, decanediol diacrylate, and dodecanediol dimethacrylate; polyfunctional (meth)acrylates of a branched, substituted polyhydric alcohol such as neopentylglycol dimethacrylate and 2-hydroxy-1,3-diacryloxypropane; polyethylene glycol di(meth)acrylate; and polypropylene polyethylene glycol di(meth)acrylates.

The content of the crosslinking agent falls within a range of preferably from 0.05 to 5 wt. %, more preferably from 0.1 to 1.0 wt. % based on the total amount of the polymerizable monomers.

In the invention, the binder resin which is to be used for the toner and can be prepared by radical polymerization of a polymerizable monomer can be polymerized using a radical polymerization initiator.

The radical polymerization initiator usable therefor is not particularly limited. Specific examples include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butylhydroperoxide pert-riphenylacetate, tert-butyl performate, tert-butyl peracetate, tert-butyl perbenzoate, tert-butyl perphenylacetate, tert-butyl permethoxyacetate, and tert-butyl per-N-(3-toluoyl)carbamate; azo compounds such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate), poly(tetraethylene glycol-2,2'-azobisisobutyrate) and 2,2'-azobis(2-methylpropionamidine) dihydrochloride; and 1,4-bis(pentaethylene)-2-tetrazene, and 1,4-dimethoxycarbonyl-1,4-diphenyl-2-tetrazene.

When a binder resin is prepared by polycondensation and/or polymerization in a water-based medium, a particle emulsion of a monomer can be prepared, for example, by uniformly mixing a monomer solution containing a cosurfactant (oil phase) with a solution of a surfactant in a water-based medium (water phase) in a shear mixer such as piston homogenizer, micro fluidizing apparatus (such as "Microfluidizer", trade name; product of Microfluidics) or ultrasonic dispersing machine, and then emulsifying the mixture. The oil phase is charged preferably in an amount of from approximately 0.1 to 50 wt. % based on the total amount of the water phase and oil phase. The surfactant is added preferably in an amount less than critical micelle concentration (CMC) in the presence of the emulsion thus formed, while the cosurfactant is added preferably in an amount of preferably from 0.1 to 40 parts by weight, more preferably from 0.1 to 20 parts by weight based on 100 parts by weight of the oil phase.

"Miniemulsion polymerization method", that is, a polymerization method of the monomer of the monomer emulsion in the presence of a polymerization initiator by using, as described above, both a surfactant in an amount less than critical micelle concentration (CMC) and a cosurfactant is preferred because polymerization of an addition polymerizable monomer occurs in monomer particles (oil droplets), making it possible to form uniform polymer particles. In the polycondensable/addition polymerizable composite polymer in the invention, "miniemulsion polymerization method" not requiring diffusion of the monomer during polymerization has an advantage in that the polycondensable polymer can remain in the polymer particles as is.

So-called "microemulsion polymerization method" of particles having a particle size of from 5 to 50 nm as described, for example, in J. S. Guo, M. S. El-Aasser, J. W. Vanderhoff; *J. Polym. Sci.: Polym. Chem. Ed.,* 27, 691 (1989) is similar to the "miniemulsion polymerization method" in the invention in dispersion structure and polymerization mechanism so that it can also be used in the invention. "Microemulsion polymerization method" however consumes a large amount of a surfactant having a concentration exceeding a critical micelle concentration (CMC) so that it may cause problems such as mixing of a large amount of the surfactant in the polymer particles thus obtained and consumption of much time for a cleaning step with water, an acid or an alkali to remove the surfactant.

For the polycondensation and/or polymerization in the water-based medium to prepare a binder resin, addition of a cosurfactant is preferred. Addition of the cosurfactant in an amount of from 0.1 to 40 wt. % based on the total amount of the monomers is more preferred. The cosurfactant is added in order to reduce Ostwald ripening in the so-called miniemulsion polymerization. As the cosurfactant, known ones as a cosurfactant in the miniemulsion polymerization are usable.

Preferred examples of the cosurfactant include, but not limited to, $C_{8-30}$ alkanes such as dodecane, hexadecane and octadecane, $C_{8-30}$ alkyl alcohols such as lauryl alcohol, cetyl alcohol and stearyl alcohol, $C_{8-30}$ alkyl mercaptans such as lauryl mercaptan, cetyl mercaptan and stearyl mercaptan, acrylates and methacrylates and polymers thereof, polymers or polyadducts such as polystyrene and polyester, carboxylates, ketones and amines.

Of these cosurfactants, hexadecane, cetyl alcohol, stearyl methacrylate, lauryl methacrylate, polyester and polystyrene are preferred. In particular, stearyl methacarylate, lauryl methacrylate, polyester and polystyrene are more preferred in order to avoid generation of a volatile organic substance.

The polymer and composition containing the polymer to be used as the cosurfactant may contain a copolymer, block copolymer, mixture or the like with another monomer. A plurality of these cosurfactants may be used in combination.

The cosurfactant may be added to either of the oil phase or water phase.

In the toner preparation in the invention, a surfactant is added for the purpose of stabilizing at the time of dispersion in the suspension polymerization method or stabilizing the dispersion of the resin particle dispersion liquid, colorant particle dispersion liquid and releasing agent particle dispersion liquid in the emulsion polymerization aggregation method.

Examples of the surfactant include anionic surfactants such as sulfate ester salt, sulfonate salt, phosphate ester, and soap; cationic surfactants such as amine salt, and quaternary ammonium salt; and nonionic surfactants such as polyethylene glycol, alkylphenol ethylene oxide adduct, and polyhyric alcohols. Of these, ionic surfactants are preferred, and anionic surfactants and cationic surfactants are more preferred.

In the toner of the invention, generally, anionic surfactants have strong dispersing force and are excellent in dispersing resin particles and a colorant. As a surfactant for dispersing a releasing agent, the anionic surfactant is advantageous.

The nonionic surfactant is used preferably in combination with the anionic surfactant or cationic surfactant. These surfactants may be used either singly or in combination.

Specific examples of the anionic surfactant include fatty acid soaps such as potassium laurate, sodium oleate, and sodium castor oil; sulfate esters such as octyl sulfate, lauryl sulfate, lauryl ether sulfate, and nonyl phenyl ether sulfate; sodium alkylnaphthalenesulfonates such as lauryl sulfonate, dodecylbenzene sulfonate, triisopropylnaphthalene sulfonate, and dibutylnaphthalene sulfonate; sulfonate salts such as naphthalene sulfonate formalin condensate, monooctyl sulfosuccinate, dioctyl sulfosuccinate, lauric amide sulfonate, and oleic amide sulfonate; phosphate esters such as lauryl phosphate, isopropyl phosphate, and nonyl phenyl ether phosphate, dialkyl sulfosuccinate salts such as sodium dioctyl sulfosuccinate; and sulfosuccinate salts such as disodium lauryl sulfosuccinate.

Specific examples of the cationic surfactants include amine salts such as laurylamine hydrochloride, stearylamine hydrochloride, oleylamine acetate, stearylamine acetate, and stearylaminopropylamine acetate; and quaternary ammonium salts such as lauryltrimethylammonium chloride, dilauryldimethylammonium chloride, distearyldimethylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenetrimethylammonium chloride, alkyltrimethylammonium chloride, and tetradecyltrimethylammonium bromide (TTAB).

Specific examples of the nonionic surfactants include alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octyl phenyl ether and polyoxyethylene nonyl phenyl ether; alkyl esters such as polyoxyethylene laurate, polyoxyethylene stearate, and polyoxyethylene oleate; alkyl amines such as polyoxyethylene laurylamino ether, polyoxyethylene stearylamino ether, polyoxyethylene oleylamino ether, polyoxyethylene soybean amino ether, and polyoxyethylene beef tallow amino ether; alkyl amides such as polyoxyethylene lauric amide, polyoxyethylene stearic amide, and polyoxyethylene oleic amide; vegetable oil ethers such as polyoxyethylene castor oil ether and polyoxyethylene rapeseed oil ether; alkanol amides such as lauric diethanolamide, stearic diethanolamide, and oleic diethanolamide; and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

The content of the surfactant in each dispersion liquid is not limited insofar as it does not inhibit the invention. It is typically small. Specifically, the content falls within a range of from 0.01 to 3 wt. %, more preferably from 0.05 to 2 wt. %, still more preferably from 0.1 to 2 wt. %. The contents within the above-described range are preferred, because the dispersion liquid such as resin particle dispersion liquid, colorant particle dispersion and releasing agent particle dispersion liquid becomes stable and aggregation or release of certain particles does not occur and the effect of the present invention is produced sufficiently. Suspension polymerization toner dispersion having a large particle size diameter is typically stable even if the content of the surfactant is small.

As the dispersion stabilizer to be used in the suspension polymerization method, sparingly water-soluble and hydrophilic inorganic powder can be used. Examples of the inorganic powder include silica, alumina, titania, calcium carbonate, magnesium carbonate, tripotassium phosphate (hydroxyapatite), clay, diatomaceous earth, and bentonite. Of these, calcium carbonate and tricalcium phosphate are preferred from the viewpoint of ease of particle size formation of particles and ease of removal.

In addition, a water-based polymer which is solid at a normal temperature may be used as the dispersion stabilizer. Specifically, cellulose compounds such as carboxymethyl cellulose and hydroxypropyl cellulose, polyvinyl alcohol, gelatin, starch, and gum arabic can be used.

[Another Binder Resin]

In the invention, the toner can employ, as another binder resin, a binder resin other than the core-shell particles.

Preferred examples of the another binder resin include ethylene resins, styrene resins, polymethyl methacrylate, (meth)acrylic resins, polyamide resins, polycarbonate resins, polyether resins, and polyester resins, and copolymer resins thereof. Of these, styrene resins, (meth)acrylic resins, and polyester resins and copolymer resins thereof are more preferred.

Polyester resins are preferably polyester usable for the core-shell particles. The polyester resins can be synthesized by a conventionally known process such as *Polycondensation* (published by Kagaku Dojin in 1971), *Polymer Experimental Studies* (*Polycondensation and Polyaddition*) (published by Kyoritsu Publishing in 1958); and *Polyester Resin Handbook* (published by Nikkan Kogyo Shinbun in 1988). They can also be synthesized using either singly or in combination an ester exchange method and direct polycondensation method.

As the another binder resin usable in the invention, addition polymerization resins are also useful. Examples of an addition polymerizable monomer for preparing the addition polymerization resins include radical polymerizable monomers, cationic polymerizable monomers and anionic polymerizable monomers, of which radical polymerizable monomers are preferred, with ethylenically unsaturated monomers being more preferred. As the radical polymerization resins, styrene resins and (meth)acrylic resins are preferred, with styrene-(meth)acrylic copolymer resins being especially preferred.

As the styrene-(meth)acrylic copolymer resins, a latex obtained by dispersion stabilization, with a surfactant, a copolymer available by polymerizing a monomer mixture composed of from 60 to 90 parts by weight of an aromatic monomer (styrene monomer) having an ethylenically unsaturated group, from 10 to 40 parts by weight of an ethylenically unsaturated carboxylate monomer ((meth)acrylate monomer), and from 1 to 3 parts by weight of an ethylenically unsaturated acid monomer. The copolymer has a glass transition temperature of preferably from 50 to 70° C.

The polymerizable monomer preferably used in the invention for preparation of the another binder resin will next be described.

Examples of the styrene monomer include styrene, vinylnaphthalene, alkyl-substituted styrenes having an alkyl chain such as 2-methylstyrene, 3-methylstyrene, 4-methylstyrene, 2-ethylstyrene, 3-ethylstyrene and 4-ethylstyrene, halogen-substituted styrenes such as 2-chlorostyrene, 3-chlorostyrene and 4-chlorostyrene, and fluorine-substituted styrenes such as 4-fluorostyrene and 2,5-difluorostyrene. As the styrene monomer, styrene is preferred.

Examples of the (meth)acrylate monomer include methyl (meth)acrylate, ethyl(meth)acrylate, n-propyl(meth)acrylate, n-butyl(meth)acrylate, n-pentyl(meth)acrylate, n-hexyl (meth)acrylate, n-heptyl(meth)acrylate, n-octyl(meth)acrylate, n-decyl(meth)acrylate, n-dodecyl(meth)acrylate, n-lauryl(meth)acrylate, n-tetradecyl(meth)acrylate, n-hexadecyl (meth)acrylate, n-octadecyl(meth)acrylate, isopropyl(meth) acrylate, isobutyl(meth)acrylate, t-butyl(meth)acrylate, isopentyl(meth)acrylate, amyl(meth)acrylate, neopentyl (meth)acrylate, isohexyl(meth)acrylate, isoheptyl(meth) acrylate, isooctyl(meth)acrylate, 2-ethylhexyl(meth)acrylate, phenyl(meth)acrylate, biphenyl(meth)acrylate, diphenylethyl(meth)acrylate, t-butylphenyl(meth)acrylate, terphenyl(meth)acrylate, cyclohexyl(meth)acrylate, t-butylcylohexyl(meth)acrylate, dimethylaminoethyl(meth)acrylate, diethylaminoethyl(meth)acrylate, methoxyethyl(meth) acrylate, 2-hydroxyethyl(meth)acrylate, β-carboxyethyl (meth)acrylate, (meth)acrylonitrile and (meth)acrylamide. Of the (meth)acrylate monomers, n-butyl(meth)acrylate is preferred.

The term "(meth)acrylate" as used herein is an abbreviation meaning methacrylate and/or acrylate.

The ethylenically unsaturated acid monomer is an ethylenically unsaturated monomer containing an acid group such as carboxyl group, sulfonic acid group or acid anhydride.

The styrene resin, (meth)acrylate resin or styrene-(meth) acrylate copolymer resin containing a carboxyl group is available by copolymerizing the resin with a polymerizable monomer having a carboxyl group.

Specific examples of the carboxyl-containing polymerizable monomer include acrylic acid, aconitic acid, atropic acid, allylmalonic acid, angelic acid, isocrotonic acid, itaconic acid, 10-undecenoic acid, elaidic acid, erucic acid, oleic acid, ortho-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butenic acid, ferulic acid, fumaric acid, brassidic acid, 2-(2-furil) acrylic acid, bromocinnamic acid, bromofumaric acid, bromomaleic acid, benzylidenemalonic acid, benzoylacrylic acid, 4-pentenoic acid, maleic acid, mesaconic acid, methacrylic acid, methylcinnamic acid and methoxycinnamic acid. From the standpoint of easiness in polymer forming reaction, acrylic acid, methacrylic acid, maleic acid, cinnamic acid and fumaric acid are preferred, with acrylic acid being more preferred.

The addition polymerization resin to be used as the another binder resin has a weight average molecular weight of preferably from 5,000 to 50,000, more preferably from 8,000 to 40,000.

The resin having the molecular weight within the above-described range is preferred because good powder properties of the toner can be maintained at normal temperature and normal pressure and offset of a fixed image during fixing can be prevented.

The another binder resin has a glass transition temperature of preferably from 45 to 65° C., more preferably from 50 to 65° C.

Glass transition temperatures within the above-described range are preferred because they can prevent deterioration of powder properties, which will otherwise be caused by a releasing agent, and facilitate oozing of the releasing agent at the time of fixing.

<Charge Controlling Agent>

A charge controlling agent may be added to the toner of the invention as needed.

Although known charge controlling agents are usable, azo metallic complex compounds, metallic complex compounds with salicylic acid and resin type charge controlling agents having a polar group are usable. In the case where the toner is prepared by a wet process, a material sparingly soluble in water is preferred for controlling the ion intensity (%) and reducing contamination of waste water. In the invention, the toner may be either a magnetic toner containing a magnetic material therein or a non-magnetic toner containing no magnetic material therein.

<Aggregating Agent>

When the emulsion aggregation coalescence method is employed for toner production, aggregation may be induced in the aggregation step by changing the pH or the like, whereby toner particles are produced. An aggregating agent may be added in order to stably and quickly induce the aggregation or to obtain aggregated particles having a narrower particle diameter distribution.

As the aggregating agent, a compound having a monovalent or higher valent one is preferred, and specific examples thereof include the above-described water soluble surfactants such as ionic surfactants and nonionic surfactants, acids such as hydrochloric acid, sulfuric acid, nitric acid, acetic acid and oxalic acid, metal salts of an inorganic acid such as magnesium chloride, sodium chloride, aluminum chloride (including poly(aluminum chloride)), aluminum sulfate, calcium sulfate, ammonium sulfate, aluminum nitrate, silver nitrate, copper sulfate and sodium carbonate, metal salts of an aliphatic acid or aromatic acid such as sodium acetate, potassium formate, sodium oxalate, sodium phthalate and potassium salicylate, metal salts of a phenol such as sodium phenolate, metal salts of an amino acid, and inorganic acid salts of an aliphatic or aromatic amine such as triethanolamine hydrochloride and aniline hydrochloride.

When stability of aggregated particles, stability of the aggregating agent against heat or passage of time or removal of it during washing are considered, metal salts of an inorganic acid has preferred as the aggregating agent from the viewpoint of its performance and ease of use. Specific examples of the metal salts of an inorganic acid include magnesium chloride, sodium chloride, aluminum chloride (including poly(aluminum chloride)), aluminum sulfate, ammonium sulfate, aluminum nitrate, silver nitrate, copper sulfate and sodium carbonate.

The addition amount of the aggregating agent may be a small amount while depending on the valency and is about 3 wt. % or less for a monovalent compound, 1 wt. % or less for a divalent compound, and 0.5 wt. % or less for a trivalent compound based on the total amount of the toner. The amount of the aggregating agent is preferably as small as possible so that use of a compound having higher valency is preferred.

<Colorant>

A colorant usable in the invention is not particularly limited and the known colorants may be used. It can be selected as needed, depending on the using purpose. It may be used either singly or two or more kinds of colorants of the same series may be used in combination. Two or more kinds of colorants of the different series may be used as a mixture. These colorants may be used after surface treatment.

Specific examples of the colorant include the following black, yellow, orange, red, blue, violet, green and white colorants.

Black pigments include organic and inorganic colorants such as carbon black, aniline black, activated charcoal, non-magnetic ferrite and magnetite.

Yellow pigments include chrome yellow, zinc yellow, yellow calcium oxide, cadmium yellow, chromium yellow, fast yellow, Fast Yellow 5G, Fast Yellow 5GX, Fast Yellow 10G, Benzidine yellow G, Benzidine Yellow GR, threne yellow, quinoline yellow, and Permanent Yellow NCG.

Orange pigments include red chrome yellow, molybdenum orange, Permanent Orange GTR, pyrazolone orange, Vulcan Orange, Benzidine orange G, Indanthrene Brilliant Orange RK, and Indanthrene Brilliant Orange GK.

Red pigments include red oxide, cadmium red, red lead, mercury sulfide, Watchung Red, Permanent Red 4R, Lithol Red, Brilliant Carmine 3B, Brilliant Carmine 6B, DuPont Oil Red, pyrazolone red, Rhodamine B Lake, Lake Red C, rose bengal, eoxine red, and alizarin lake.

Blue pigments include organic and inorganic colorants such as Iron Blue, Cobalt Blue, Alkali Blue Lake, Victoria Blue Lake, Fast Sky Blue, Indanthrene Blue BC, Ultramarine Blue, Phthalocyanine Blue and Phthalocyanine Green.

Violet pigments include organic and inorganic colorants such as Manganese Violet, Fast Violet B and Methyl Violet Lake.

Green pigments include organic and inorganic colorants as chromium oxide, Chrome Green, Pigment Green B, Malachite Green Lake and Final Yellow Green G.

White pigments include zinc white, titanium oxide, antimony white, and zinc sulfide.

Extender pigments include barytes, barium carbonate, clay, silica, white carbon, talc, and alumina white.

<Dispersing Method of Colorant>

The colorant used in the toner of the invention can be dispersed in the binder resin in a known manner. When the toner is prepared by kneading and pulverizing method, the colorant may be used as is; may be used as a master batch obtained by dispersing the colorant in the resin in advance in a high concentration, which is kneaded with the binder resin at the time of kneading, or may be used by flashing after dispersing, in the resin, a colorant in the form of a wet cake before drying.

The colorant may be used as is when the toner is prepared by the suspension polymerization method, in which the colorant dispersed in the resin is dissolved or dispersed in a polymerizable monomer to disperse the colorant in the pulverized particles.

When the toner is prepared by the emulsion polymerization aggregation method, the colorant and a dispersing agent such as surfactant are dispersed in a water-based medium by applying mechanical impacts and then, the resulting colorant dispersion liquid is aggregated with resin particles, followed by grinding into a toner particle size.

More specifically, the dispersion of colorant particles can be prepared utilizing mechanical impacts, for example, using a rotation shearing homogenizer, a media dispersing machine such as ball mill, sand mill and attritor, or a high-pressure counter collision dispersing machine. The colorant can also be dispersed in a water-based medium with a homogenizer by using a surfactant having polarity.

In order to ensure the color developing property upon fixing, the colorant is preferably added in an amount of from 4 to 15 wt. %, more preferably from 4 to 10 wt. % based on the total solid weight of the toner. When a magnetic material is used as a black colorant, the amount thereof is preferably from 12 to 48 wt. %, more preferably from 15 to 40 wt. %. Toners such as yellow toner, magenta toner, cyan toner, black toner, white toner and green toner can be obtained by appropriately selecting the kind of the colorants.

(Releasing Agent)

A releasing agent may be added to the toner of the invention as needed. The releasing agent is generally used for improving the releasing property.

Specific examples of the releasing agent include low molecular weight polyolefins such as polyethylene, polypropylene and polybutene; long-chain fatty acids such as palmitic acid and silicones having a softening temperature upon heating; fatty acid amides such as oleic amide, erucic amide, ricinoleic amide and stearic amide; vegetable waxes such as carnauba wax, rice wax, candelilla wax, haze wax and jojoba oil; animal waxes such as bees wax; mineral or petroleum waxes such as montan wax, ozokerite, ceresin, paraffin wax, microcrystalline wax and Fischer-Tropsch wax; and ester waxes such as fatty acid ester, montanate ester and carboxylate ester. In the invention, these releasing agents may be used either singly or in combination.

The amount of the releasing agent is preferably from about 1 to 20 wt. %, more preferably from about 5 to 15 wt. % based on the total amount of the toner particles. Amounts within the above-described range are preferred, because the releasing agent produces sufficient effects and moreover, the toner particles are not broken easily inside a developing apparatus, making it possible to prevent the releasing agent from adhering to the carrier to cause a spent problem and also prevent deterioration in charging property.

<Magnetic Material>

In the invention, a magnetic material may be added to the toner as needed.

Examples of the magnetic material include metals such as iron, cobalt and nickel showing ferromagnetism and alloys or compounds containing such an element such as ferrite and magnetite; alloys which do not contain a ferromagnetic element but will show strong magnetism after adequate heat treatment, for example, alloys called Heusler alloys containing manganese and copper such as manganese-copper-aluminum and manganese-copper-tin; and chromium dioxide. For preparation of a black toner, magnetite which is itself black and functions as a colorant is particularly preferred. For preparation of a color toner, a less blackening magnetic material such as metal iron is preferred. Some magnetic materials function as a colorant and in this case, they may be used also as a colorant. For preparation of a magnetic toner, the magnetic material is added in an amount of from 20 to 70 parts by weight, more preferably from 40 to 70 parts by weight based on 100 parts by weight of the toner.

<Internal Additive>

In the invention, an internal additive may be added to the toner. The internal additive is typically used for controlling the viscoelasticity of an image to be fixed.

Specific examples of the internal additive include inorganic particles such as silica and titania and organic particles such as polymethyl methacrylate. Surface treatment may be given to them for the purpose of increasing their dispersibility. These internal additives may be used either singly or in combination.

<External Additive>

In the invention, an external additive such as fluidizer and antistatic agent may be added to the toner.

Known materials are usable as the external additive and examples of it include inorganic particles such as silica particles of which the surface is treated with a silane coupling agent, titanium oxide particles, alumina particles, cerium oxide particles and carbon black; polymer particles such as polycarbonate, polymethyl methacrylate, and silicone resin; amine metal salts; and salicylic acid metal complexes. These external additives usable in the invention may be used either singly or in combination.

In the invention, the toner has a cumulative volume average particle size $D_{50}$ of from about 3.0 to 9.0 μm, more preferably from about 3.0 to 7.0 μm. $D_{50}$ of 3.0 μm or greater provides an adequate adhesive force and good developing property, while $D_{50}$ of 9.0 μm provides an excellent resolution property. $D_{50}$ within the above-described range is therefore preferred.

In the invention, the volume average particle size distribution index GSDv of the toner is preferably not greater than about 1.30. GSDv not greater than 1.30 is preferred because it provides a good resolution property and prevents scattering of the toner or fog and also image defects.

In the invention, the cumulative volume average particle size $D_{50}$ and the average particle size distribution index of the toner can be determined, for example, in the following manner. Based on the particle size distribution measured by a measuring apparatus such as "Coulter Counter TAII" (trade name; product of Nikkaki) and "Multisizer II" (trade name; product of Nikkaki), cumulative distributions of the volume and the number are drawn from the small diameter side with respect to the divided particle size ranges (channels). The particle sizes at a cumulative amount of 16% are designated as $D_{16V}$ for volume and $D_{16P}$ for number, the particle sizes at a cumulative amount of 50% are designated as $D_{50V}$ for volume and $D_{50P}$ for number, and the particle sizes at a cumulative amount of 84% are designated as $D_{84V}$ for volume and $D_{84P}$ for number. By using these values, the volume average particle size distribution index (GSDv) is calculated as $(D_{84V}/D_{16V})^{1/2}$, and the number average particle size distribution index (GSDp) is calculated as $(D_{84P}/D_{16P})^{1/2}$.

The shape factor SF1 of the toner is preferably from about 110 to about 140, more preferably from about 120 to about 140. It is known that spherical toner is easily transferred in the transfer step in the electrophotographic step, while amorphous toner is easily cleaned off in the cleaning step.

The SF1 is a shape factor showing the degree of irregularities on the surface of the toner particles and it is calculated in the following manner. An optical micrograph of the toner scattered on slide glass is imported into a Luzex image analyzer through a video camera.

The SF1 is calculated based on the square of the maximum length/projected area ($(ML)^2/A$) of 50 toner particles in accordance with the following equation and an average SF1 is determined.

$$SF1 = \frac{(ML)^2}{A} \times \frac{\pi}{4} \times 100 \quad \text{[Equation 1]}$$

(wherein ML represents the maximum length of a toner particle and A represents a projected area of the particle).

(Preparation Process of Toner)

In the invention, a toner can be prepared by a mechanical process such as pulverization or a so-called chemical process using a resin particle dispersion liquid prepared from the binder resin. In the invention, the toner may be either a so-called pulverized toner or polymerized toner, but polymerized toner is preferred.

The preparation process of the toner is not particularly limited in the invention insofar as it is a known process such as kneading and pulverizing method, aggregation coalescence method and suspension polymerization method. Of these, the aggregation coalescence method is preferred, with the emulsion polymerization aggregation method being especially preferred.

In the invention, the toner is prepared preferably by the aggregation coalescence method and it includes preferably at least a step of aggregating binder resin particles in a dispersion containing the resin particles to prepare aggregated particles (which may hereinafter be called "aggregation step") and a step of heating and coalescing the aggregated particles (which may hereinafter be called "coalescence step").

In the aggregation step, the binder resin is preferably used as a binder resin particle dispersion liquid.

A method of dispersing the binder resin in a water-based medium and forming particles can be selected from known methods such as forced emulsification, self emulsification and phase-inversion emulsification. Of these, self emulsification and phase-inversion emulsification methods are preferred in view of energy necessary for emulsification, controllability of particle size of the emulsion thus obtained, stability and the like.

A description of self emulsification and phase-inversion emulsification can be found in *Application Technology of Ultrafine Particle Polymer* (CMC Publishing). A polar group to be used for self emulsification is, for example, a carboxyl group or sulfone group.

As will be described later, use of, as the binder resin particle dispersion liquid, a dispersion of a binder resin obtained by emulsion polymerization by miniemulsion or the like method is also preferred.

A dispersion liquid of the another binder resin may be prepared using an organic solvent. When the organic solvent is used, resin particles are formed preferably by removing a portion of the organic solvent.

For example, it is preferred to emulsify a material containing the binder resin, and then removing a portion of the organic solvent to solidify the remaining portion as particles. Specific solidification methods include a method of emulsifying and dispersing a material containing a polycondensation resin in a water-based medium and then drying the organic solvent at a vapor-liquid interface while stirring the dispersion liquid and feeding air or an inert gas such as nitrogen thereto (air blowing drying method), a method of drying the dispersion liquid while maintaining it under reduced pressure and, if necessary, bubbling an inert gas as needed (a pressure reduction topping method), and a method of discharging, like shower, an emulsified dispersion liquid obtained by emulsifying and dispersing a material containing a polycondensation resin in a water-based medium or an emulsion of a material containing a polycondensation resin, from apertures to a saucer and repeating this procedure to dry the organic solvent (a shower system desolvating method). It is preferred to remove the solvent by using the method selected properly from them or a combination of the methods, depending on the evaporation speed and water solubility of the organic solvent to be used.

The median diameter (middle diameter) of the resin particle dispersion liquid of the invention is preferably 0.05 μm or greater but not greater than 2.0 μm, more preferably 0.1 μm or greater but not greater than 1.5 μm, still more preferably 0.1 μm or greater but not greater than 1.0 μm. The median diameter falling within the above range is preferred because the dispersion state of the resin particles in the water-based medium becomes stabile. When resin particles having such a median diameter are used for the preparation of a toner, its particle size can be controlled easily and a releasing property and offset prevention at the time of fixation are excellent, so that they are preferred.

The median diameter of resin particles can be measured, for example, with a laser diffraction particle size distribution analyzer ("LA-920", trade name; product of Horiba, Ltd.).

Although no particular limitation is imposed on the aggregation method in the aggregation step, aggregation methods conventionally employed in the emulsion polymerization aggregation method of a toner, for example, a method of reducing the stability of an emulsion by temperature elevation, pH change, salt addition or the like and stirring it with a disperser or the like are usable.

In the above-described aggregation step, particles in a mixture of the resin particle dispersion liquid and the colorant dispersion liquid and, if necessary, the releasing agent dispersion liquid aggregate with each other to form aggregated particles having a toner particle size. The aggregated particles are formed by heteroaggregation or the like. An ionic surfactant having a polarity different from that of the aggregated particles or a monovalent or polyvalent compound such as metal salt can be added for the purpose of stabilizing the aggregated particles or regulate their particle size or particle size distribution.

In the aggregation step, the particle size and particle size distribution of the toner can be regulated, for example, by polymerizing, in the presence of a polymerization initiator, a monomer in an oil droplet emulsified and dispersed in a water phase to obtain resin polymer particles and aggregating (associating) the polymer particles thus obtained by a known aggregation method of aggregating (associating) particles containing at least colorant particles (when the colorant is added to the resin in advance in the polymerization step, the term "particles containing at least the colorant particles" means "colorant particles" themselves). An emulsion polymerization aggregation method for the preparation of toner particles is preferably employed. Described specifically, toner particles are available by mixing the resin particle dispersion liquid with the colorant particle dispersion liquid and releasing agent particle dispersion liquid, adding an aggregating agent to the resulting mixture to cause heteroaggregation and form aggregated particles of a toner diameter, coalescing these aggregated particles by heating them at a temperature of the glass transition temperature or melting temperature of the resin particles or greater, and washing and drying. The toner shape can be controlled from amorphous to spherical by selecting the heating temperature.

The aggregation step can be performed after two or more resin particle dispersion liquids are mixed. In this case, it is possible to form multilayer particles, for example, by aggregating one of these resin particle dispersion liquids in advance to form first aggregated particles and adding another resin particle dispersion liquid to form a second shell layer on the surface of the first aggregated particles. It is of course possible to form multilayer particles in reverse order.

After the aggregation treatment, the surfaces of the particles may be crosslinked by heat treatment in order to suppress leaching of the colorant out of the surfaces of the particles. The surfactant and the like employed therefor may be removed as needed by washing with water, an acid or an alkali.

In the coalescence step, the binder resin in the aggregated particles is melted at the melting temperature or glass transition temperature of the binder resin or greater, whereby the shape of the aggregated particles changes from amorphous to spherical.

The phase separated structure of the core-shell particles in the toner is maintained preferably by melting at a temperature within +50° C. of the glass transition temperature of the shell-constituting used. The coalescence at a temperature within +50° C. of the glass transition temperature of the shell-constituting resin is preferred because the coalescence between the core resins hardly proceeds so that a micro-phase separated structure can be maintained and pressure-induced plasticization occurs sufficiently.

The aggregated particles are then separated from the water-based medium, followed by washing and drying if necessary, whereby formation of toner particles is completed.

A desired toner may be formed by carrying out, after completion of the aggregation step and coalescence step, an arbitrary washing step, solid-liquid separation step and drying step. In the washing step, washing while replacing with deionized water sufficiently is preferred from the viewpoint of charging property. The solid-liquid separation step is not particularly limited, but suction filtration, pressure filtration and the like are preferred from the viewpoint of productivity. Further, the drying step is not particularly limited, but freeze drying, flash jet drying, fluidized drying and oscillation type fluidized drying and the like are preferred from the viewpoint of productivity.

(Developing Agent)

The toner (electrostatic image developing toner) described above can be used as a developing agent (electrostatic latent image developing agent). There is no particular limitation imposed on this developing agent insofar as it contains the toner. Its composition can be varied as needed, depending on the using purpose. A one-part type developing agent is available by using the toner alone, while two-part type developing agent is available by using the toner in combination with a carrier.

The carrier usable in the invention is not particularly limited, but examples include magnetic particles such as iron powder, ferrite, iron oxide powder and nickel; resin-coated carriers obtained by using magnetic particles as a core material and coating the surface thereof with a resin such as styrene resin, vinyl resin, ethylene resin, rosin resin, polyester resin or melamine resin or wax such as stearic acid to form a resin coated layer; and magnetic-material-dispersed carriers obtained by dispersing magnetic particles in a binder resin. Of these, resin-coated carriers are especially preferred because the charging property and resistance of the whole carrier can be controlled by the constitution of the resin coated layer.

In the two-part type electrostatic image developing agent, the toner is usually added preferably in an amount of from 2 to 10 parts by weight based on 100 parts by weight of the carrier. Although no particular limitation is imposed on the preparation process of the developing agent, examples include mixing in a V blender.

(Image Forming Method and Image Forming Apparatus)

An image forming method according to the invention has (a) a step of forming an electrostatic latent image on the surface of a latent image carrier, (b) a step of developing the electrostatic latent image with a developing agent containing a toner to form a toner image, (c) a step of transferring the toner image onto the surface of a member to be transferred to obtain a transferred toner image; and (d) a step of fixing the transferred toner image to the surface of the member to be transferred, wherein the fixing step is a step of fixing the transferred toner image by application of pressure without heating.

An image forming apparatus according to the invention has a unit for forming an electrostatic latent image on the surface of a latent image carrier, a unit for developing the electrostatic latent image with a developing agent containing a toner to form a toner image; a unit for transferring the toner image onto the surface of a member to be transferred; and a unit for fixing the thus transferred toner image onto the member to be transferred, wherein the toner is available by aggregating resin particles having a core-shell structure; resins constituting the core and shell are each a non-crystalline resin; the core-constituting resin and the shell-constituting resin are different in glass transition temperature by 20° C. or greater; the shell-constituting resin contains an acidic or basic polar group, or an alcoholic hydroxy group; and the fixing unit is a pressurizing unit not equipped with a heating unit.

Known methods and units employed in the conventional image forming method and image forming apparatus can be used for the above-described steps and units, respectively. In the invention, the member to be transferred is a final recording medium. When an intermediate transfer member is employed, the toner image formed on the surface of the electrostatic latent image carrier is once transferred to the intermediate transfer member and then finally transferred finally to the member to be transferred. The toner image transferred to the surface of the member to be transferred is fixed thereonto.

The above-described image forming method may further have another step, for example, a step of cleaning the surface of the latent image carrier. The image forming apparatus may further have a unit for cleaning the surface of the latent image carrier.

An electrophotographic photoreceptor is used as the latent image carrier, the following procedure is followed. After charging the surface of the electrophotographic photoreceptor uniformly with a corotron charging unit or contact charging unit, an electrostatic image is formed by exposure. It is then brought into contact with or brought close to a development roller having, on the surface layer thereof, a developing agent layer, whereby toner particles are adhered to the electrostatic image to form a toner image on the electrophotographic photoreceptor. The toner image thus formed is transferred to the surface of a member to be transferred such as paper by utilizing a corotron charging unit or the like. The toner image transferred to the surface of a recording medium is fixed with a fixing unit, whereby the image is formed on the recording medium.

As the electrophotographic photoreceptor, an inorganic photoreceptor such as amorphous silicon or selenium or an organic photoreceptor using polysilane or phthalocyanine as a charge generating material or charge transport material is usable, but an amorphous silicon photoreceptor is especially preferred because it has a long life.

<Fixing Step and Fixing Unit>

In the invention, the fixing step is performed by applying pressure without heating. The fixing unit does not have a heating unit.

A fixing pressure is preferably about 1.5 MPa or greater but not greater than about 10 MPa, more preferably about 2 MPa or greater but not greater than about 8 MPa, still more preferably about 3 MPa or greater but not greater than about 7 MPa.

When the pressure at the time of fixing (fixing pressure) is 1.5 MPa or greater, a sufficient fixing property can be provided. When the pressure is not greater than 10 MPa, on the other hand, problems such as contamination of an image or fixing roll due to toner offset and winding of paper around the fixing roll do not readily occur. In addition, curling of paper after fixing (which is called "paper curling") rarely occurs. Pressures at the fixing time within the above-described range are therefore preferred.

The term "fixing pressure" as used herein means the following maximum fixing pressure.

As the fixing roll, a proper one selected from conventionally known fixing rolls is usable insofar as the above-described fixing pressure can be applied thereto.

Examples of the fixing roll include fixing rolls obtained by coating a core metal of a cylinder with a fluorine resin (such as Teflon (trade mark)), a silicone resin or a perfluoroalkylate. A fixing roll made of SUS is also usable to provide a high fixing pressure. The fixing step is usually performed by passing the member to be transferred between two rolls. These two rolls may be made of the same material or different materials. Examples of the combination of the materials include SUS/SUS, SUS/silicone resin, SUS/PFA and PFA/PFA.

The pressure distribution between fixing rolls or pressure rolls can be measured using a commercially available pressure distribution measuring sensor. Specifically, a roller-roller pressure measuring system manufactured by Kamata Industries is usable. In the invention, the maximum pressure at the time of pressure fixing is the maximum pressure in a pressure change of a fixing nip from the inlet to the outlet along the paper traveling direction.

In the invention, the fixing step is performed without heating. The term "fixing is performed without heating" as used herein means that the apparatus has no unit capable of directly heating the fixing unit. An elevation of the temperature in the apparatus to an ambient temperature by heat emitted from another energy source is not refused.

The fixing temperature is preferably from about 15 to about 50° C., more preferably from about 15 to about 45° C., still more preferably from about 15 to about 40° C.

The fixing temperatures within the above-described range are preferred because they can provide a good fixing property.

<Cleaning Step and Cleaning Unit>

The image forming method of the present invention has, after the transfer step, a step of cleaning the toner residue from the surface of the latent image carrier. The cleaning step is preferably a brush cleaning step in which the toner residue is cleaned off with a brush. The image forming apparatus of the invention has preferably a cleaning unit and the cleaning unit is more preferably a brush cleaning unit.

For the cleaning of the toner residue from the photoreceptor after transfer, a brush cleaning system with less stress to each toner is suited. An elastic blade may be employed subsidiarily while reducing a pressing pressure, but it is preferred to carry out brush cleaning mainly.

In general, the toner residue is cleaned from the surface of the latent image carrier with a cleaning blade or cleaning brush. In the invention, cleaning of the toner residue with a cleaning brush is preferred.

The brush cleaning step is preferred because less pressure is applied onto the toner residue and therefore the toner does not adhere to the photoreceptor. Blade cleaning may cause filming or the like, because the toner residue is fluidized by the stress from the cleaning blade and adheres to the photoreceptor.

The brush cleaning unit to be used in the invention is a toner removing member with a brush member and has various forms depending on the using purpose, for example, a brush such as fixed brush, a rotary brush having fibers arranged cylindrically therearound and used by turning it. A conductive brush formed of conductive fibers and used by applying a voltage thereto is also usable.

Examples of the fibers for the brush include, but not limited to, natural cellulose fibers, regenerated cellulose fibers such as rayon, nylon fibers, polypropylene fibers, polyester fibers, polyurethane fibers, polyolefin fibers, acrylic fibers, polyamide fibers, polyamideimide fibers, polyetheramide fibers, polyphenylene sulfide fibers, polybenzimidazole fibers and polyvinyl fibers.

To impart conductivity to these fibers, carbon black, metal oxide powder, metal powder or conductive resin may be added to these fibers. The brush of the toner removing member may be equipped with a toner scraper as needed. One or a plurality of the toner removing members may be disposed per electrostatic latent image carrier. In an especially preferred mode of the cleaning unit, a toner removing member having conductive fibers arranged cylindrically therearound is placed adjacent to the electrostatic latent image carrier; a flicker bar for dislodging the toner from the brush fibers is disposed adjacent to the toner removing member; and it has a toner collecting container for collecting the toner thus dislodged.

The drawing is a cross-sectional view schematically illustrating the basic constitution of one preferred exemplary embodiment of the image forming apparatus of the invention. An image forming apparatus 100 shown in the drawing is equipped with an electrophotographic photoreceptor (image carrier) 107, a charging device 108 such as corotron or scorotron for charging the electrophotographic photoreceptor 107, a power supply 109 connected to the charging device 108, an exposure device (latent image forming unit) 110 for exposing the electrophotographic photoreceptor 107, when it is charged by the charging device 108, to form an electrostatic latent image, a developing device (developing unit) 111 for developing the electrostatic latent image formed by the exposing device 110 with a toner to form a toner image, a transfer device (transfer unit) 112 for transferring the toner image formed by the developing device 111 to a member to be transferred 500, a cleaning unit 113 for removing the toner residue from the surface of the electrophotographic photoreceptor 107 after transfer, a static eliminator 114, and a fixing device (fixing unit) 115.

In the drawing, the cleaning unit 113 is a brush cleaning unit and the toner residue on the electrophotographic photoreceptor 107 is removed by a brushing member. The fixing device 115 is a pressure fixing device and has no heating unit.

For the above-described devices of the image forming apparatus 100, those employed in the conventional image forming apparatuses can be used, respectively.

In the invention, the image forming apparatus does not necessarily have the static eliminator 114. The charging device 108 is a contact type one in the drawing, but it may be a non-contact type such as corotron charging unit.

(Member to be Transferred)

In the invention, a member to be transferred is not limited. In the invention, a transfer paper having a formation index of about 20 or greater is preferably used as the member to be transferred. The formation index is more preferably about 23 or greater, still more preferably about 25 or greater.

In order to realize a uniform fixing property of an image within the paper, it is important to reduce the formation unevenness of the paper. Reduction in the formation unevenness decreases the pressure distribution during pressure fixing of a toner to the paper and a toner having a small particle size can be fixed uniformly. This makes it possible to simultaneously satisfy the image quality and pressure fixing property.

A transfer paper having a formation index of 20 or greater is preferred because it has small formation unevenness and therefore satisfies both the image quality and pressure fixing property.

Here, the formation index is measured in the following manner.

It is measured using a 3D Sheet Analyzer ("M/K950", trade name; manufactured by M/K Systems, Inc. (MKS Inc.)) while setting the diameter of the diaphragm of the analyzer to 1.5 mm and using a micro-formation tester (MFT). Described specifically, a sample is installed on a rotating drum of the 3D Sheet Analyzer to measure a difference in local basic weight of the sample as a difference in the amount of light by using a light source attached onto the drum shaft and a photodetector placed outside the drum at the position corresponding to the light source. A measurement range is adjusted by the diameter of a diaphragm to be attached to the light inlet portion of the photodetector. Next, the difference (deviation) in the amount of light is amplified, A/D converted and classified into 64 optical basis weight classes. By one scanning, 1,000,000 pieces of data are taken to obtain a frequency histogram of the data. Then, the maximum frequency (peak value) of the histogram is divided by the number of the classes having a frequency of 100 or more, among the 64 classes corresponding to micro basis weights, and the obtained value is multiplied by 1/100 to calculate the formation index. F1 is indicated by the following equation:

$$F1=(\text{peak value(frequency)}/(\text{the number of classes of 100 frequencies or greater})\times(1/100)$$

The transfer paper having a greater formation index has a more uniform paper quality and better formation.

Examples of a method for reducing the formation unevenness of a transfer paper serving as a fixing medium include, but not limited to, a method of disposing a screen of a base paper or a vortex cleaner immediately upstream of a head box of a paper machine to prevent the flowing direction of a paper stock from being fixed and a method of controlling formation of flocs of a paper stock by using a known chemical such as guar gum, locust bean gum, mannogalactan, deacetylated karaya gum, alginate, carboxymethyl cellulose, methyl cellulose or hydroxyethyl cellulose.

The formation unevenness can be reduced also by disposing a coating layer on a base paper. The coating layer of a coated paper is formed to heighten smoothness, uniformity, opacity and whiteness of the transfer paper, reinforce its strength and heighten the image forming suitability of the transfer paper. The coating layer is composed mainly of a pigment, a pigment dispersing agent, and a binder resin. Examples of the pigment usable for the coating layer include kaolin clay, delaminated clay, Georgia clay, China clay, calcium carbonate, satin white, titanium oxide and aluminum hydroxide; those of the pigment dispersing agent include sodium pyrophosphate, sodium polyacrylate, sodium hexametaphosphate, sodium tripolyphosphate and styrene-maleic acid copolymer sodium; and those of the binder resin include polyvinyl alcohol, carboxymethyl celluloe, styrene butadiene latex, various starches, casein, soybean protein, vinyl acetate latex, and vinyl acetate-dibutyl maleate copolymer.

After a coating solution is prepared by dispersing and dissolving the pigment, binder and the like, it is coated onto a transfer paper by using a roll coater, air knife coater, rod coater or cast coater, followed by drying with an infrared dryer, drum dryer, air cap dryer, air foil dryer or air conveyer dryer.

With regard to the paper with a coating layer, an average (base paper):pigment:(binder resin) mass ratio is approximately 70:25:5%.

The transfer paper used in the image forming method of the invention is typically formed using wood pulp as a main raw material and the transfer paper contains a filler. The filler added to the transfer paper is a white filler such as heavy or light calcium carbonate, talc, kaolin, clay, titanium dioxide, zeolite or white carbon. Of these, calcium carbonate is preferred because it has a good color developing property of a color material. Since the filler increases voids of the transfer paper and improves opacity so that it is added in an amount of preferably from 5 to 30 wt. %, more preferably from 10 to 25 wt. %. When the amount is not greater than 30 wt. %, the transfer paper has high strength and does not emit paper dust. The amounts of the filler within the above-described range are therefore preferred.

The present invention will hereinafter be described in further detail by Examples and Comparative Examples. It should however be borne in mind that the present invention is not limited to or by them.

In the following Examples and Comparative Examples, all the designations of "part" or "parts" mean "part by weight" or "parts by weight" unless otherwise specifically indicated.

(Measurement of Molecular Weight)

The weight average molecular weight Mw and number average molecular weight Mn are measured by gel permeation chromatography (GPC) under the below-described conditions. Measurement is conducted by feeding a solvent (tetrahydrofuran) at a flow rate of 1.2 ml per minute at 40° C. and pouring a tetrahydrofuran sample solution having a concentration of 0.2 g/20 ml in an amount of 3 mg in terms of a sample weight. In the measurement of the molecular weight of the sample, measurement conditions are selected so that the molecular weight of the sample falls within a range in which the logarithm of the molecular weight of a calibration curve plotted based on several monodisperse polystyrene standard samples and count value form a straight line. The measurement results are confirmed to be reliable when an NBS706 polystyrene standard sample has:

weight average molecular weight $Mw=28.8\times10^4$ and number average molecular weight $Mn=13.7\times10^4$ under the above-described measurement conditions.

As the column of GPC, "TSK-GEL, GMH" (trade name; product of TOSOH) which satisfies the above-described conditions is employed.

(Measurement of Median Diameter)

The measuring instrument of a median diameter differs depending on the particle size of particles to be measured. The median diameter of particles having a particle size less than 1 μm is measured by a laser diffraction particle size distribution analyzer ("LA-920", trade name; product of Horiba, Ltd.), while that of particles having a particle size of 1 μm or greater is measured by "Coulter Multisizer II" (trade name; product of Beckman Coulter).

(Measurement of Glass Transition Temperature and Melting Temperature)

The glass transition temperature and melting temperature of a resin is measured using a differential scanning calorimeter ("DSC-50", trade name; product of Shimadzu Corporation).

(Measurement of Formation Index)

A formation index is measured in the following manner.

By using a microformation tester manufactured by MKS Inc., light is irradiated from the backside of a transfer paper attached to a drum made of a transparent Pyrex (trade mark). The amount of light passing through the paper in a minute area portion is received by a detector, photoelectrically converted, and then AD converted, whereby the amounts of light are acquired as data. The data over the whole 180×250 mm area are collected by transferring the light source and detector in the direction of the shaft of the rotating drum. The light amount distribution data are divided equally into 64 equal classes and the histogram of the frequency per amount of light is drawn. The formation index (FI) is calculated based on a ratio of the frequency of a peak class to the number of the classes having a frequency of 100 or more. F1=(peak value (frequency)/(the number of classes of 100 frequencies or greater)×(1/100)

According to the above measurement method of the formation index, C2 paper, JD paper and S paper, each product of Fuji Xerox have a formation index of 23, 38 and 13, respectively. The higher the formation index, the smaller the formation unevenness of the paper.

TABLE 1

| | Formation index |
|---|---|
| C2 paper | 23 |
| JD paper | 38 |
| S paper | 13 |

(Fixing Test, Image Maintenance Test)

The fixing and image maintenance tests are carried out using a remodeled machine of "Docu Print C2425" (trade name; manufactured by Fuji Xerox). The printer uses a brush cleaner for cleaning a transfer toner residue from a photoreceptor.

A fixing machine obtained by remodeling a two-roll type fixing machine capable of regulating the maximum fixing pressure and having, on the side of an image, a high-hardness roll having a Teflon™-coated SUS tube instead of its original pressure roll is used.

As the transfer paper, the above-described C2 paper, JD paper and S paper are employed.

<Preparation of Resin Particle Dispersion Liquid (A1)

(Using Styrene-Butyl Acrylate and an Acidic Polar Group)

In a round glass flask are charged 300 parts by weight of deionized water and 1.5 parts by weight of TTAB (tetradecyltrimethylammonium bromide, product of Sigma Aldrich) and nitrogen bubbling is performed for 20 minutes. The temperature is raised to 65° C. under stirring. To the reaction mixture is added 40 parts by weight of an n-butyl acrylate monomer, followed by stirring for further 20 minutes. After 0.5 part by weight of a initiator "V-50" (trade name of 2,2'-azobis(2-methylpropionamidine)dihydrochloride, product of Wako Pure Chemicals) is dissolved in 10 parts by weight of deionized water in advance, the resulting solution is charged in the flask. After maintaining the temperature at 65° C. for 3 hours, an emulsion obtained by emulsifying 55 parts by weight of a styrene monomer, 15 parts by weight of an n-butyl acrylate monomer, 2.5 parts by weight of acrylic acid and 0.8 part by weight of dodecanethiol in 100 parts by weight of deionized water having 0.5 part by weight of TTAB dissolved therein is charged in the flask continuously through a metering pump over 2 hours. The temperature is raised to 70° C. and it is maintained for 2 hours, whereby the polymerization is completed. A core-shell resin particle dispersion liquid (A1) having a weight-average molecular weight Mw of 25,000, an average particle size of 150 nm and a solid content of 25 wt. % is obtained.

The resin particles are confirmed to be core-shell resin particles by embedding them in an epoxy resin, preparing their cross-sectional section using a diamond knife, staining in ruthenium vapor, and observing with a transmission electron microscope.

After air drying of the resin at 40° C., the Tg behavior of it from −150° C. is analyzed using a differential scanning calorimeter (DSC) manufactured by Shimadzu. As a result, glass transition due to polybutyl acrylate is observed at approximately −50° C. and glass transition due to a copolymer, which is presumed to be a styrene-butyl acrylate-acrylic acid copolymer, is observed at approximately 56° C. (difference in glass transition temperature: 106° C.).

<Preparation of Resin Particle Dispersion Liquid (A2)

(Using Styrene-2-Ethylhexyl Acrylate (EHA) and a Basic Polar Group)

In a round glass flask are charged 300 parts by weight of deionized water and 1.5 parts by weight of TTAB (tetradecyltrimethylammonium bromide, product of Sigma Aldrich) and nitrogen bubbling is performed for 20 minutes. The temperature is raised to 65° C. under stirring. To the reaction mixture is added 40 parts by weight of a 2-ethylhexyl acrylate monomer, followed by stirring for further 20 minutes. After 0.5 part by weight of an initiator "V-50" (trade name of 2,2'-azobis(2-methylpropionamidine)dihydrochloride, product of Wako Pure Chemicals) is dissolved in 10 parts by weight of deionized water in advance, the resulting solution is charged in the flask. The temperature is maintained at 65° C. for 3 hours. An emulsion obtained by emulsifying 55 parts by weight of a styrene monomer, 15 parts by weight of an n-butyl acrylate monomer, 1.2 parts by weight of diethylaminoethyl acrylate and 0.8 part by weight of dodecanethiol in 100 parts by weight of deionized water having 0.5 part by weight of TTAB dissolved therein is charged in the flask continuously through a metering pump over 2 hours. The temperature is raised to 70° C. and it is maintained for 2 hours, whereby the polymerization is completed. A core-shell resin particle dispersion liquid (A2) having a weight-average molecular weight Mw of 25,000, an average particle size of 130 nm and a solid content of 25 wt. % is obtained.

The resin particles are confirmed to be core-shell resin particles by embedding them in an epoxy resin, preparing their cross-sectional section using a diamond knife, staining in ruthenium vapor, and observing with a transmission electron microscope.

After air drying of the resin at 40° C., the Tg behavior of it from −150° C. is analyzed using a differential scanning calorimeter (DSC) manufactured by Shimadzu. As a result, glass transition due to poly(2-ethylhexyl acrylate) is observed at approximately −65° C. and glass transition due to a copolymer, which is presumed to be a styrene-butyl acrylate-diethylaminoethyl acrylate copolymer, is observed at approximately 54° C. (difference in glass transition temperature: 119° C.).

<Preparation of Resin Particle Dispersion Liquid (A3)

(Using Styrene-Butyl Methacrylate (nBMA) and an Alcoholic Hydroxy Group)

In a round glass flask are charged 300 parts by weight of deionized water and 1.5 parts by weight of TTAB (tetradecyltrimethylammonium bromide, product of Sigma Aldrich) and nitrogen bubbling is performed for 20 minutes. The temperature is raised to 65° C. under stirring. To the reaction mixture is added 40 parts by weight of an n-butyl methacrylate monomer, followed by stirring for further 20 minutes. After 0.5 part by weight of an initiator "V-50" (trade name of 2,2'-azobis(2-methylpropionamidine)dihydrochloride, product of Wako Pure Chemicals) is dissolved in 10 parts by weight of deionized water in advance, the resulting solution is charged in the flask. The temperature is maintained at 65° C. for 3 hours. An emulsion obtained by emulsifying 55 parts by weight of a styrene monomer, 20 parts by weight of an n-butyl acrylate monomer, 2 parts by weight of 2-hydroxyethyl methacrylate and 0.8 part by weight of dodecanethiol in 100 parts by weight of deionized water having 0.5 parts by weight of TTAB dissolved therein is charged in the flask continuously through a metering pump over 2 hours. The temperature is raised to 70° C. and it is maintained for 2 hours, whereby the polymerization is completed. A core-shell resin particle dispersion liquid (A3) having a weight-average molecular weight Mw of 25,000, an average particle size of 260 nm and a solid content of 25 wt. % is obtained.

The resin particles are confirmed to be core-shell resin particles by embedding them in an epoxy resin, preparing their cross-sectional section using a diamond knife, staining in ruthenium vapor, and observing with a transmission electron microscope.

After air drying of the resin at 40° C., the Tg behavior of it from −150° C. is analyzed using a differential scanning calorimeter (DSC) manufactured by Shimadzu. As a result, glass transition due to polybutyl methacrylate is observed at approximately 25° C. and glass transition due to a copolymer, which is presumed to be a styrene-butyl acrylate-2-hydroxyethyl methacrylate copolymer, is observed at approximately 48° C. (difference in glass transition temperature: 23° C.).

<Preparation of Resin Particle Dispersion Liquid (A4) (Using Conventional Styrene-Butyl Acrylate (BA) and an Acidic Polar Group)

| | |
|---|---|
| Styrene | 460 parts by weight |
| n-butyl acrylate | 140 parts by weight |
| Acrylic acid | 12 parts by weight |
| Dodecanethiol | 9 parts by weight |

The above-described components are mixed and dissolved to prepare a solution.

Separately, an emulsion is prepared by dissolving 12 parts by weight of an anionic surfactant ("DOWFAX", trade mark; product of Dow Chemical) in 250 parts by weight of deionized water and the solution prepared above is added. The mixture is dispersed and emulsified in a flask (Monomer emulsion A).

Further, 1 part by weight of an anionic surfactant ("DOWFAX", trade mark; product of Dow Chemical) is dissolved in 555 parts by weight of deionized water and the resulting solution is charged in a polymerization flask.

The polymerization flask is hermetically sealed and equipped with a reflux tube. While pouring nitrogen into the flask and stirring slowly, the polymerization flask is heated on a water bath to 75° C., at which the flask is maintained.

In 43 parts by weight of deionized water is dissolved 9 parts by weight of ammonium persulfate. After the resulting solution is added dropwise to the polymerization flask through a metering pump over 20 minutes, the monomer emulsion A is also added dropwise over 200 minutes through a metering pump. While continuing stirring slowly, the polymerization flask is maintained at 75° C. for 3 hours to complete the polymerization.

As a result, a noncrystalline resin particle dispersion liquid (A4) having a middle particle diameter of 210 nm, a glass transition temperature of 53.5° C., a weight average molecular weight of 31,000 and a solid content of 42% is obtained.

<Preparation of Resin Particle Dispersion Liquid (A5) (Using Styrene-Butyl Methacrylate (nBMA) and an Alcoholic Hydroxy Group)

In a round glass flask are charged 300 parts by weight of deionized water and 1.5 parts by weight of TTAB (tetradecyltrimethylammonium bromide, product of Sigma Aldrich) and nitrogen bubbling is performed for 20 minutes. The temperature is raised to 65° C. under stirring. To the reaction mixture is added 40 parts by weight of an n-butyl methacrylate monomer, followed by stirring for further 20 minutes. After 0.5 part by weight of an initiator "V-50" (trade name of 2,2'-azobis(2-methylpropionamidine)dihydrochloride, product of Wako Pure Chemicals) is dissolved in 10 parts by weight of deionized water in advance, the resulting solution is charged in the flask. The temperature is maintained at 65° C. for 3 hours. An emulsion obtained by emulsifying 50 parts by weight of a styrene monomer, 30 parts by weight of an n-butyl acrylate monomer, 2 parts by weight of 2-hydroxyethyl methacrylate and 0.8 part by weight of dodecanethiol in 100 parts by weight of deionized water having 0.5 part by weight of TTAB dissolved therein is charged in the flask continuously through a metering pump over 2 hours. The temperature is raised to 70° C. and it is maintained for 2 hours, whereby the polymerization is completed. A core-shell resin particle dispersion liquid (A5) having a weight-average molecular weight Mw of 25,000, an average particle size of 280 nm and a solid content of 25 wt. % is obtained.

The resin particles are confirmed to be core-shell resin particles by embedding them in an epoxy resin, preparing their cross-sectional section using a diamond knife, staining in ruthenium vapor, and observing with a transmission electron microscope.

After air drying of the resin at 40° C., the Tg behavior from −150° C. is analyzed using a differential scanning calorimeter (DSC) manufactured by Shimadzu. As a result, glass transition due to polybutyl methacrylate is observed at approximately 25° C. and glass transition due to a copolymer, which is presumed to a styrene-butyl acrylate-2-hydroxyethyl methacrylate copolymer, is observed at approximately 40° C. (difference in glass transition temperature: 15° C.).

<Preparation of Resin Particle Dispersion Liquid (A6) (Using Methyl Methacrylate-Butyl Acrylate and an Acidic Polar Group)

In a round glass flask are charged 300 parts by weight of deionized water and 1.5 parts by weight of TTAB (tetradecyltrimethylammonium bromide, product of Sigma Aldrich) and nitrogen bubbling is performed for 20 minutes. The temperature is raised to 65° C. under stirring. To the reaction mixture is added 40 parts by weight of an n-butyl methacrylate monomer, followed by stirring for further 20 minutes. After 0.5 part by weight of an initiator "V-50" (trade name of 2,2'-azobis(2-methylpropionamidine)dihydrochloride, product of Wako Pure Chemicals) is dissolved in 10 parts by weight of deionized water in advance, the resulting solution is charged in the flask. The flask is maintained at 65° C. for 3 hours. An emulsion obtained by emulsifying 60 parts by weight of a methyl methacrylate monomer, 15 parts by weight of an n-butyl acrylate monomer, 2 parts by weight of acrylic acid and 0.8 part by weight of dodecanethiol in 100 parts by weight of deionized water having 0.5 part by weight of TTAB dissolved therein is charged in the flask continuously through a metering pump over 2 hours. The temperature is raised to 70° C. and it is maintained for 2 hours, whereby the polymerization is completed. A core-shell resin particle dispersion liquid (A6) having a weight-average molecular weight Mw of 25,000, an average particle size of 110 nm and a solid content of 25 wt. % is obtained.

The resin particles are confirmed to be core-shell resin particles by embedding them in an epoxy resin, preparing their cross-sectional section using a diamond knife, staining in ruthenium vapor, and observing with a transmission electron microscope.

After air drying of the resin at 40° C., the Tg behavior from −150° C. is analyzed using a differential scanning calorimeter (DSC) manufactured by Shimadzu. As a result, glass transition due to polybutyl acrylate is observed at approximately −50° C. and glass transition due to a copolymer, which is presumed to be a methyl acrylate-n-butyl acrylate-2-acrylic acid copolymer, is observed at approximately 50° C. (difference in glass transition temperature: 100° C.).

The resin particle dispersion liquids (A1) to (A6) are shown in the following table.

TABLE 2

| | Resin particle dispersion liquid | | | | | |
|---|---|---|---|---|---|---|
| | A1 | A2 | A3 | A4 | A5 | A6 |
| Tg of core (° C.) | −50 | −65 | 25 | 53.5 | 25 | −50 |
| Tg of shell (° C.) | 56 | 54 | 48 | 53.5 | 40 | 50 |
| Tg difference between core and shell (° C.) | 106 | 119 | 23 | 0 | 15 | 100 |
| Weight average molecular weight | 25,000 | 25,000 | 25,000 | 31,000 | 25,000 | 25,000 |
| Average particle size of resin particles (nm) | 150 | 130 | 260 | 210 | 280 | 110 |
| Solid content (%) | 25 | 25 | 25 | 42 | 25 | 25 |

<Preparation of Colorant Particle Dispersion Liquid (1)>

| | |
|---|---|
| Cyan pigment (product of DainichiSeika Color & Chemicals, Copper phthalocyanine: C.I. Pigment Blue 15:3) | 50 parts by weight |
| Anionic surfactant ("NOIGEN RK", trade name; product of Daiichi Kogyo Seiyaku) | 5 parts by weight |
| Deionized water | 200 parts by weight |

The above-described components are dissolved by mixing. The resulting solution is dispersed by treating for 5 minutes with a homogenizer ("Ultra Turrax", trade mark, product of IKA) and then for 10 minutes on a ultrasonic bath, whereby a colorant particle dispersion liquid (P1) having a middle diameter 190 nm and a solid content of 21.5% is obtained.

<Preparation of Colorant Particle Dispersion Liquid (2)>

In a similar manner to that employed for preparation of the colorant particle dispersion liquid (1) except for the use of a magenta pigment (product of Dainippon Ink & Chemical, "C.I. Pigment Red 122") instead of the cyan pigment, a magenta colorant particle dispersion liquid (P2) having a middle diameter of 165 nm and a solid content of 21.5% is obtained.

<Preparation of Releasing-Agent Particle Dispersion Liquid (1)>

An aqueous solution of dodecylsulfuric acid is prepared by mixing:

| | |
|---|---|
| dodecylsulfuric acid | 30 parts by weight, and |
| deionized water | 852 parts by weight. |

After mixing:

| | |
|---|---|
| palmitic acid | 188 parts by weight, and |
| pentaerythritol | 25 parts by weight, and |

heating to 250° C. for melting, the aqueous solution of dodecylsulfuric acid obtained above is charged. The resulting mixture is emulsified for 5 minutes in a homogenizer ("Ultra Turrax", trade mark; product of IKA), followed by emulsification in a ultrasonic bath for 15 minutes. While stirring the resulting emulsion, the temperature is maintained at 70° C. in the flask for 15 hours, whereby a releasing agent particle dispersion liquid (W1) having a middle particle diameter of 200 nm, a melting temperature of 72° C. and a solid content of 20% is obtained.

<Preparation of Releasing-Agent Particle Dispersion Liquid (2)>

After mixing:

| | |
|---|---|
| anionic surfactant ("Noigen RK", trade name; product of Daiichi Kogyo Seiyaku) | 2 parts by weight, |
| deionized water | 800 parts by weight, and |
| carnauba wax | 200 parts by weight, and |

heating to 100° C. for melting, the reaction mixture is emulsified for 15 minutes in a homogenizer ("Ultra Turrax", trade mark; product of IKA), followed by emulsification in a gaulin homogenizer at 100° C., whereby a releasing agent particle dispersion liquid (W2) having a middle particle diameter of 170 nm, a melting temperature of 83° C. and a solid content of 20% is obtained.

Toner Example 1

Preparation of Toner Particles

| | |
|---|---|
| Resin particle dispersion liquid (A1) | 168 parts by weight (Resin: 42 parts by weight) |
| Colorant particle dispersion liquid (P1) | 40 parts by weight (Pigment: 8.6 parts by weight) |
| Releasing agent particle dispersion liquid (W1) | 40 parts by weight (Releasing agent: 8.6 parts by weight) |
| Poly(aluminum chloride) | 0.15 part by weight |
| Deionized water | 300 parts by weight |

In accordance with the above-described formulation, the components charged in a round flask made of stainless steel are mixed and dispersed sufficiently by using a homogenizer ("Ultra Turrax T50", product of IKA). The flask is heated to 42° C. in a heating oil bath while stirring. After maintaining the dispersion at 42° C. for 60 minutes, 84 parts by weight (resin: 21 parts by weight) of the resin particle dispersion liquid (A1) is added thereto and the mixture is stirred mildly.

The pH in the system is adjusted to 6.0 with a 0.5 mole/L aqueous solution of sodium hydroxide. The dispersion is heated to 95° C. while continuing stirring. During heating to 95° C., the aqueous solution of sodium hydroxide is added dropwise to prevent a reduction of pH to 5.0 or less. The dispersion is maintained at 95° C. for 3 hours.

After completion of the reaction, the reaction mixture is cooled, filtered, and washed with deionized water sufficiently. Then, solid-liquid separation is performed using a Nutsche filter. After re-dispersion in 3 L of deionized water of 40° C., the resulting dispersion is washed by stirring for 15 minutes at 300 rpm. The washing operation is repeated five times, followed by solid-liquid separation through Nutsche suction filtration and then vacuum drying for 12 hours, whereby toner particles are obtained.

The particle size of the resulting toner particles is measured using a Coulter counter, resulting in a cumulative volume-average particle size $D_{50}$ of 5.8 μm and a volume-average particle size distribution index GSDv of 1.22. The shape factor SF1 of the toner particles determined by the observation of the shape by Luzex (trade mark) is 130 meaning that they are potato-shaped particles.

To 50 parts by weight of the toner particles is added 1.5 parts by weight of hydrophobic silica ("TS720", trade name; product of Cabot Corporation), followed by mixing in a sample mill, whereby an external addition toner is obtained.

The external toner is weighed to give a toner concentration of 5% and a ferrite carrier having an average particle size of 50 μm and coated with 1% of poly(methyl methacrylate) (product of Soken Kagaku) are mixed by stirring for 5 minutes in a ball mill to prepare a developing agent.

<Evaluation of Toner>

The toner thus obtained is evaluated using the developer thus obtained and a re-modeled machine of "DocuPrint C2425" (trade name; product of Fuji Xerox). A two-roll type fixing device is remodeled to give the maximum fixing pressure of 5 MPa (50 kgf/cm$^2$). As transfer paper, C2 paper (formation index: 23, product of Fuji Xerox) is used and the processing speed is adjusted to 180 mm/sec. A fixing device of the remodeled machine is not equipped with a heating unit. In addition, the toner remaining after transfer is cleaned from a photoreceptor with a brush cleaner.

The fixing property of the toner is studied. As a result, its oilless fixing property and evenness upon pressure fixing are good. Both of its developing property and transfer property are good and the image thus formed has a high quality without image defects (A). In the above-described remodeled machine, 50,000 sheets of paper are printed continuously at 23° C. and 55% RH, but the initial good image quality is maintained throughout the printing (maintenance at continuous test: A)

Toners (developers) are evaluated in accordance with the following criteria.

a: Oilless Fixing Property

Toners not winding around a heating roll even without applying oil to the roll in advance are rated good.

b. Evenness Upon Pressure Fixing

Toners not causing deficiencies of a fixed image even when rubbing the whole surface of the fixed image strongly with a gauze cloth are rated good.

c. Image Quality

Thin-line reproducibility, that is, quality of an image on which thin lines have been fixed and fogging (visually) of an unfixed portion are observed with a magnifying glass and are rated in accordance with the following criteria:

A: Uniform thin lines and no fogging.

B: Slight unevenness in image quality.

C: Unevenness in image quality.

d. Maintenance at Continuous Test

Under conditions at 23° C. and 55% RH, 50,000 sheets of paper are printed continuously and the images thus formed are rated in accordance with the following criteria:

A: The initial good image is maintained throughout the test.

B: Deterioration in the image quality is observed but it is practically acceptable.

C: Some deterioration in the image quality is observed.

D: Apparent deterioration in the image quality is observed.

Toner Example 2

In a similar manner to Toner Example 1 except that the resin particle dispersion liquid (A2), the releasing agent particle dispersion liquid (W1) and the colorant particle dispersion liquid (P2) are used; poly(aluminum chloride) is replaced by aluminum sulfate; and pH at the time of raising temperature to 95° C. is changed to 7.0, a toner is prepared and rated. Its oilless pressure fixing property and evenness upon pressure fixing are good. Both developing property and transfer property are good. Since it does not have image defects and shows a high quality, the image quality is rated good (A). As a result of the continuous printing test of 50,000 sheets of paper at 23° C. and 55% RH by using the remodeled machine, the initial good image quality is not lost throughout the printing (maintenance at continuous test: A)

Toner Example 3

In a similar manner to Toner Example 1 except that the resin particle dispersion liquid (A3), the releasing agent particle dispersion liquid (W2) and the colorant particle dispersion liquid (P2) are used, a toner is prepared.

As in Example 1 except for the use of JD paper (formation index: 38) made of Fuji Xerox as a transfer paper, the toner thus prepared is rated.

Its oilless pressure fixing property and evenness upon pressure fixing are good. Both the developing property and transfer property are good. Since it does not have image defects and has a high quality, the image quality is rated good (A). As a result of the continuous printing test of 50,000 sheets of paper at 23° C. and 55% RH by using the remodeled machine, deterioration of the initial good image quality is observed but it is practically acceptable (maintenance at continuous test: B).

Toner Example 4

In a similar manner to Toner Example 1 except that the resin particle dispersion liquid (A1) is replaced by a 1:1 mixture of the resin particle size dispersion liquid (A1) and the resin particle dispersion liquid (A4), a toner is prepared. As in Example 1 except for the use of JD paper (formation index: 38) made of Fuji Xerox as a transfer paper, the toner thus prepared is rated.

Its oilless pressure fixing property and evenness upon pressure fixing are good. Both the developing property and transfer property are good. Since it does not have image defects and has a high quality, the image quality is rated good (A). As a result of the continuous printing test of 50,000 sheets of paper at 23° C. and 55% RH by using the remodeled machine, the initial good image quality is not lost throughout the printing (maintenance at continuous test: A)

Toner Comparative Example 1

In a similar manner to Toner Example 1 except for the use of the resin particle dispersion liquid (A5), a toner is prepared and rated. Its oilless fixing property and evenness upon pressure fixing are good. Slight image unevenness is observed in the initial image quality (image rating: B). At a continuous test, after printing of about 10,000 sheets of paper, toner filming occurs on the photoreceptor and streaky defects are observed (maintenance at continuous test: C)

Toner Comparative Example 2

In a similar manner to Toner Example 1 except for the use of the resin particle dispersion liquid (A4), a toner is prepared and rated. It has an insufficient oilless pressure fixing property and winds around a roll (poor oilless pressure fixing property). The evenness upon pressure fixing is also poor and many image deficiencies appear by rubbing the image with gauze. Although the toner has a good developing property and transfer property, the continuous test is not carried out owing to the problem in fixing property.

Toner Example 5

In a similar manner to Toner Example 1 except for the use of the resin particle dispersion liquid (A6), a toner is prepared. Its oilless pressure fixing property and evenness upon pressure fixing are good. Both the developing property and transfer property are good. Since it does not have image defects and has a high quality, the image quality is rated good (A). As a result of the continuous printing test of 50,000 sheets of paper at 23° C. and 55% RH by using the remodeled machine, the initial good image quality is not lost throughout the printing (maintenance at continuous test: A).

Toner Example 6

In a similar manner to Toner Example 1 except for the use of S paper (formation index: 13), product of Fuji Xerox as a transfer paper, a toner is prepared and rated. Its oilless pressure fixing property is good but evenness upon pressure fixing is insufficient. Some image deficiencies appear (B) by rubbing with a gauze cloth, but they are industrially acceptable. Both the developing property and transfer property are good. Since it does not have image defects and has high quality, the image quality is rated good (A). As a result of the continuous printing test of 50,000 sheets of paper at 23° C. and 55% RH by using the remodeled machine, the initial good image quality is not lost throughout the printing (maintenance at continuous test: A) in spite of insufficient evenness upon pressure fixing.

Toner Example 7

In a similar manner to Toner Example 1 except that the brush cleaner of the remodeled machine of "DocuPrint C2425" (trade name; product of Fuji Xerox) is replaced by a blade cleaner), a toner is prepared and rated.

As a result, its oilless pressure fixing property and evenness upon pressure fixing are good. Both the developing property and fixing property are good. The image quality is rated good (A). The maintenance at the continuous printing test of 50,000 sheets of paper at 23° C. and 55% RH by using the remodeled machine is rated B.

Toner Example 8

In a similar manner to Toner Example 1 except that the maximum fixing pressure of the remodeled machine of "DocuPrint C2425" (trade name; product of Fuji Xerox) is changed to 8.5 MPa, a toner is prepared and rated.

Its oilless pressure fixing property and evenness upon pressure fixing are good. Both the developing property and fixing property are good. It has a good image quality without image defects (A). The maintenance at the continuous printing test of 50,000 sheets of paper at 23° C. and 55% RH by using the remodeled machine is rated A.

The results are shown in the following table.

TABLE 3

| | Ex. 1 | Ex. 2 | Ex. 3 | Ex. 4 | Ex. 5 | Ex. 6 | Ex. 7 | Ex. 8 | Comp. Ex. 1 | Comp. Ex. 2 |
|---|---|---|---|---|---|---|---|---|---|---|
| Resin particle dispersion liquid | A1 | A2 | A3 | A1:A4 = 1:1 | A5 | A1 | A1 | A1 | A5 | A4 |
| $D_{50}$ of toner (μm) | 5.8 | 6.5 | 4 | 5.2 | 5.5 | 5.8 | 5.8 | 5.8 | 4.8 | 5.3 |
| GSDv | 1.22 | 1.24 | 1.23 | 1.24 | 1.22 | 1.22 | 1.22 | 1.22 | 1.24 | 1.23 |
| SF1 | 130 | 122 | 128 | 125 | 132 | 130 | 130 | 130 | 130 | 128 |
| Maximum fixing pressure (MPa) | 5 | 5 | 5 | 5 | 5 | 5 | 5 | 8.5 | 5 | 5 |
| Cleaning unit | Brush | Brush | Brush | Brush | Brush | Brush | Blade | Brush | Brush | Brush |
| Formation index | 23 | 23 | 38 | 38 | 23 | 13 | 23 | 23 | 23 | 23 |
| Oilless fixing property | Good | Good | Good | Good | Good | Good | Good | Good | Good | Poor |
| Evenness upon pressure fixing | Good | Good | Good | Good | Good | Some deficiencies but acceptable | Good | Good | Good | Poor |
| Image quality | A | A | A | A | A | A | A | A | C | D |
| Maintenance at continuous test | A | A | B | A | A | A | C | A | D | — |

What is claimed is:

1. An image forming method comprising:

forming an electrostatic latent image on a surface of a latent image carrier;

developing the electrostatic latent image with a developing agent comprising a toner to form a toner image;

transferring the toner image onto a surface of a target to obtain a transferred toner image; and fixing the transferred toner image;

wherein the toner comprises a resin particle having a core-shell structure, comprising a resin constituting a core and a resin constituting a shell, the resin constituting the core is a non-crystalline resin, and the resin constituting the shell is a non-crystalline resin, a glass transition temperature of the resin constituting the core and a glass transition temperature of the resin constituting the shell are different by about 20° C. or greater, the resin constituting the shell is obtained by copolymerization of a monomer having an acidic polar group, a basic polar group, or an alcoholic hydroxy group, and at least one other monomer, the content of the monomer having an acidic polar group, a basic polar group, or an alcoholic hydroxyl group is from 0.01 wt % to 20 wt % based on a total weight of the monomers constituting the shell, and the fixing of the transferred toner image is performed by applying a pressure on the transferred toner image without heating.

2. The image forming method according to claim 1, wherein the pressure applied at the fixing of the transferred toner image is from about 1.5 MPa to about 10 MPa.

3. The image forming method according to claim 1, wherein the fixing of the transferred toner image is performed at a temperature of from about 15° C. to about 50° C.

4. The image forming method according to claim 1, further comprising:

cleaning a toner residue from the surface of the latent image carrier with a brush after the transferring of the toner image.

5. The image forming method according to claim 1, wherein the target is a transfer paper having a formation index of about 20 or greater.

6. The image forming method according to claim 1, wherein the higher of the glass transition temperature of the resin constituting the core and the glass transition temperature the resin constituting the shell is from about 40° C. to about 80°.

7. The image forming method according to claim 1, wherein the resin constituting the core has a weight-average molecular weight of about from 3,000 to about 50,000.

8. The image forming method according to claim 1, wherein the resin constituting the shell has a weight-average molecular weight of about from 3,000 to about 50,000.

9. The image forming method according to claim 1, wherein the resin particle having the core-shell structure is contained in an amount of about 20% or greater based on a total weight of the toner.

10. The image forming method according to claim 1, wherein the acidic polar group is a carboxyl group, a sulfonic acid group or an acid anhydride.

11. The image forming method according to claim 1, wherein the basic polar group is an amino group, an amide group, or a hydrazide group.

12. The image forming method according to claim 1, wherein the resin particle having the core-shell structure has a median diameter (middle diameter) of about from ½ to about $1/1{,}000$ relative to a volume-average particle size of the toner.

13. The image forming method according to claim 1, wherein the toner comprises a releasing agent in an amount of from about 1 wt. % to about 20 wt. % based on a total amount of toner particles contained in the toner.

14. The image forming method according to claim 1, wherein the toner has a cumulative volume average particle size $D_{50}$ of from about 3.0 μm to about 9.0 μm.

15. The image forming method according to claim 1, wherein the toner has a volume average particle size distribution index GSDv of about 1.30 or less.

16. The image forming method according to claim 1, wherein the toner has a shape factor SF1 of from about 110 to about 140.

* * * * *